US011365649B2

(12) United States Patent
Kuwamura et al.

(10) Patent No.: US 11,365,649 B2
(45) Date of Patent: Jun. 21, 2022

(54) STEAM TURBINE AND EXHAUST CHAMBER THEREFOR

(71) Applicant: Mitsubishi Power, Ltd., Yokohama (JP)

(72) Inventors: Yoshihiro Kuwamura, Tokyo (JP); Hideaki Sugishita, Tokyo (JP); Kazuyuki Matsumoto, Tokyo (JP); Toyoharu Nishikawa, Tokyo (JP); Shigeo Ookura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/417,188

(22) PCT Filed: Nov. 26, 2019

(86) PCT No.: PCT/JP2019/046090
§ 371 (c)(1),
(2) Date: Jun. 22, 2021

(87) PCT Pub. No.: WO2020/137308
PCT Pub. Date: Jul. 2, 2020

(65) Prior Publication Data

US 2022/0074319 A1 Mar. 10, 2022

(30) Foreign Application Priority Data

Dec. 28, 2018 (JP) ..... JP2018-247168

(51) Int. Cl.
*F01D 25/24* (2006.01)
*F01D 25/30* (2006.01)

(52) U.S. Cl.
CPC ..... *F01D 25/24* (2013.01); *F05D 2220/31* (2013.01)

(58) Field of Classification Search
CPC ..... F01D 25/30; F01D 25/24; F01D 9/065; F01D 25/14; F01D 25/28; F01D 9/045; F01D 11/24
See application file for complete search history.

(56) References Cited

U.S. PATENT DOCUMENTS 5,257,906 A * 11/1993 Gray ..... F01D 25/30 415/225
6,261,055 B1 * 7/2001 Owczarek ..... F01D 1/02 415/211.2

(Continued)

FOREIGN PATENT DOCUMENTS

JP H08-260904 A 10/1996
JP 2002-081301 A 3/2002

(Continued)

OTHER PUBLICATIONS

International Search Report dated Feb. 10, 2020, issued in counterpart Application No. PCT/JP2019/046090, with English translation. (4pages).

(Continued)

*Primary Examiner* — Long T Tran
(74) *Attorney, Agent, or Firm* — WHDA, LLP

(57) ABSTRACT

An exhaust chamber is equipped with: a diffuser that forms a diffuser space; an exhaust casing that forms an exhaust space communicating with the diffuser space; and an auxiliary exhaust frame that forms an auxiliary exhaust space having an annular shape centered around an axis, on the inside of the diffuser in the radial direction. The auxiliary exhaust frame has an opening that opens toward the outside in the radial direction from the interior of the auxiliary exhaust space, and that enables the exhaust space and the auxiliary exhaust space to communicate with each other.

12 Claims, 18 Drawing Sheets

(56) References Cited

U.S. PATENT DOCUMENTS

| | | | | |
|---|---|---|---|---|
| 6,419,448 | B1 | 7/2002 | Owczarek | |
| 7,731,475 | B2 * | 6/2010 | Hardin | F01D 25/30 415/207 |
| 8,317,467 | B2 * | 11/2012 | Dalsania | F01D 25/30 415/207 |
| 8,439,633 | B2 * | 5/2013 | Mundra | F01D 1/00 415/178 |
| 10,036,265 | B2 * | 7/2018 | Mori | F01D 25/24 |
| 2002/0127100 | A1 | 9/2002 | Kreitmeier | |
| 2010/0251716 | A1 | 10/2010 | Boss et al. | |
| 2011/0158799 | A1 | 6/2011 | Dalsania et al. | |
| 2013/0149107 | A1 * | 6/2013 | Munshi | F01D 25/12 415/116 |
| 2018/0142573 | A1 * | 5/2018 | Takagi | F01D 25/26 |
| 2018/0202320 | A1 * | 7/2018 | Mitsui | F01D 25/30 |
| 2019/0277162 | A1 * | 9/2019 | Ono | F01D 25/162 |
| 2019/0353053 | A1 * | 11/2019 | Kuwamura | F01D 1/02 |
| 2020/0011206 | A1 | 1/2020 | Murakami et al. | |
| 2020/0173309 | A1 * | 6/2020 | Sugishita | F01D 25/30 |
| 2021/0285338 | A1 | 9/2021 | Kuwamura | |

FOREIGN PATENT DOCUMENTS

| | | | |
|---|---|---|---|
| JP | 2009-036118 | A | 2/2009 |
| JP | 2009-103099 | A | 5/2009 |
| JP | 2010-242759 | A | 10/2010 |
| JP | 2011-137460 | A | 7/2011 |
| JP | 2011-220125 | A | 11/2011 |
| JP | 2016-217285 | A | 12/2016 |
| WO | 2018/079805 | A1 | 5/2018 |
| WO | 2018/181855 | A1 | 10/2018 |

OTHER PUBLICATIONS

Written Opinion dated Feb. 10, 2020, issued in counterpart Application No. PCT /JP2019/046090, with English translation. (13pages).

* cited by examiner

STEAM TURBINE AND EXHAUST CHAMBER THEREFOR

TECHNICAL FIELD

The present invention relates to a steam turbine and an exhaust chamber therefor.

Priority is claimed on Japanese Patent Application No. 2018-247168, filed on Dec. 28, 2018, the content of which is incorporated herein by reference.

BACKGROUND ART

A steam turbine includes an exhaust chamber that guides steam flowing out from a last stage rotor blade row of a turbine rotor to an outside. The exhaust chamber has a diffuser and an exhaust casing. The diffuser has an annular shape with respect to an axis of the turbine rotor, and forms a diffuser space gradually facing a radial outer side toward an axial downstream side. The diffuser has an outer diffuser (or a steam guide and a flow guide) that defines an edge on the radial outer side of the diffuser space, and an inner diffuser (or a bearing cone) that defines an edge on a radial inner side of the diffuser space. The steam flowing out from the last stage rotor blade row of the turbine rotor flows into the diffuser space. The exhaust casing communicates with the diffuser space, and spreads in a circumferential direction with respect to the axis, thereby forming an exhaust space through which the steam from the diffuser space flows. The exhaust casing has an exhaust port for exhausting the steam flowing inside the exhaust space to the outside.

For example, the exhaust casing in the exhaust chamber disclosed in PTL 1 below has a casing downstream-side end plate that defines an edge on the axial downstream side of the exhaust space, and a casing outer peripheral plate that defines an edge on the radial outer side of the exhaust space. The casing downstream-side end plate is perpendicular to the axis, and spreads to the radial outer side from an edge on the axial downstream side of the inner diffuser. The steam turbine is a downward exhaust type steam turbine. Therefore, the exhaust port is formed in a lower portion of the casing outer peripheral plate. The casing outer peripheral plate is connected to an edge on the radial outer side of the casing downstream-side end plate, and spreads in the circumferential direction around the axis.

The exhaust chamber in the steam turbine further has a bypass wall plate on the radial outer side of the inner diffuser to form a bypass passage having an annular shape around the axis. The bypass wall plate extends to the radial outer side, and spreads in the circumferential direction toward the axial downstream side. The edge on the axial downstream side of the bypass wall plate is connected to a position on the radial outer side from a position to which the inner diffuser is connected, on the casing downstream-side end plate. The bypass wall plate has openings through which the diffuser space and the bypass passage communicate with each other, on a lower side where the exhaust port is formed with reference to the axis and an upper side opposite thereto. The opening on the upper side is open from the inside of the bypass passage toward the axial upstream side. The steam inside the diffuser space flows into the bypass passage via the opening on the upper side. The steam flowing into the bypass passage returns to the inside of the diffuser space via the opening on the lower side.

According to a technique disclosed in PTL 1, in order to reduce a pressure loss of the steam inside the exhaust space and in an upper region with reference to the axis, a portion of the steam inside the diffuser space and in the upper region with reference to the axis is introduced into the bypass passage, and the steam is caused to return from the pass passage into the diffuser space and into a lower region with reference to the axis.

CITATION LIST

Patent Literature

[PTL 1] U.S. Pat. No. 6,419,448

SUMMARY OF INVENTION

Technical Problem

In an exhaust chamber, a pressure of steam flowing out from a last stage rotor blade row is restored. As a pressure recovery amount increases, the pressure of the steam is lowered immediately after the steam flows out from the last stage rotor blade row, thereby improving turbine efficiency. Therefore, it is desirable to increase the pressure recovery amount by reducing a pressure loss of the steam flowing inside the exhaust chamber.

In addition, in recent years, since renewable energy such as wind power and solar energy is substituted, there is a demand for a flexible operation for absorbing load fluctuations in a thermal power plant. When the flexible operation is performed, in some cases, an operation other than a rated operation may be performed. When the operation other than the rated operation is performed, delamination or a backflow occurs inside the exhaust chamber, and the pressure loss increases inside the exhaust chamber, thereby decreasing the pressure recovery amount.

Therefore, an object of the present invention is to provide an exhaust chamber and a steam turbine including the exhaust chamber, which are capable of increasing a pressure recovery amount by reducing a pressure loss of steam.

Solution to Problem

According to an aspect of the invention, in order to achieve the above-described object, there is provided an exhaust chamber of a steam turbine which guides steam flowing out from a last stage rotor blade row of a steam turbine rotor rotating around an axis to an outside.

The exhaust chamber includes a diffuser into which the steam flowing out from the last stage rotor blade row flows, having an annular shape with respect to the axis, and forming a diffuser space that gradually spreads to a radial outer side with respect to the axis toward an axial downstream side, an exhaust casing having an exhaust port open toward the radial outer side, communicating with the diffuser space, spreading in a circumferential direction with respect to the axis, and forming an exhaust space that guides the steam flowing from the diffuser space to the exhaust port, and an auxiliary exhaust frame including a partial region on a radial inner side from the diffuser with respect to the axis, and forming an exhaust auxiliary space having an annular shape around the axis. The diffuser has an outer diffuser having an annular cross section perpendicular to the axis, gradually spreading to the radial outer side toward the axial downstream side, and defining an edge on the radial outer side of the diffuser space, and an inner diffuser having an annular cross section perpendicular to the axis, gradually spreading to the radial outer side toward the axial downstream side, and defining an edge on the radial inner side of the diffuser space with respect to the axis. The exhaust casing has an exhaust port only on an exhaust side, out of a non-exhaust side and the exhaust side which are sides to opposite to each other with reference to the axis in an orthogonal direction orthogonal to the axis. The auxiliary exhaust frame has an opening open toward the radial outer side from an inside of the exhaust auxiliary space, in at least a portion on the non-exhaust side and the exhaust side with reference to the axis, and through which the exhaust space and the exhaust auxiliary space communicate with each other.

In some cases, a circulation region in which the steam circulates may be formed inside the exhaust main flow path formed by the diffuser space and the exhaust space and in a region on the non-exhaust side with reference to the axis. In particular, in a case of a low load operation having a low flow rate of the steam flowing into the steam turbine, or in a case of a low vacuum degree inside the condenser, there is a high possibility that the circulation region may be formed. When the circulation region is formed inside the exhaust main flow path in this way, a pressure loss of the steam increases, and a pressure recovery amount of the steam inside the exhaust main flow path decreases.

The above-described circulation region is formed in a region along the casing downstream-side end plate that defines the edge on the axial downstream side of the exhaust space, in the configuration elements of the exhaust casing. Inside the circulation region, a portion of the steam flows to the radial inner side along the casing downstream-side end plate. In the present aspect, even when the steam flows in this way, the steam enters the inside of the exhaust auxiliary space via the opening in the portion on the non-exhaust side of the auxiliary exhaust frame. The steam passes through the opening in the portion on the exhaust side of the auxiliary exhaust frame, flows into the region on the exhaust side with reference to the axis in the exhaust main flow path, and is exhausted from the exhaust port.

In the present aspect, the opening of the auxiliary exhaust frame is open from the inside toward the radial outer side of the exhaust auxiliary space. Therefore, in the present aspect, the steam flowing to the radial inner side along the casing downstream-side end plate inside the exhaust main flow path and inside the region on the non-exhaust side with reference to the axis is likely to enter the inside of the exhaust auxiliary space via the opening in the portion on the non-exhaust side of the auxiliary exhaust frame.

Therefore, in the present aspect, the circulation region is reduced, and the circulation region can be limited within the region on the radial outer side inside the exhaust main flow path. Therefore, in the present aspect, the pressure loss of the steam is reduced, and the pressure recovery amount of the steam inside the exhaust main flow path can be improved.

Here, in the exhaust chamber according to the aspect, the auxiliary exhaust frame may have a frame downstream-side end plate that defines an edge on the axial downstream side in the exhaust auxiliary space. The exhaust casing may have a casing downstream-side end plate that defines an edge on the axial downstream side in the exhaust space. In this case, the frame downstream-side end plate spreads in the direction including the radial component with respect to the axis and in the circumferential direction, and has an annular shape around the axis. The casing downstream-side end plate spreads in the direction including the radial component with respect to the axis and in the circumferential direction, and has an edge on the radial inner side having an annular shape around the axis. An edge on the radial outer side of the frame downstream-side end plate defines an edge on the axial downstream side of the opening. The edge on the radial inner side of the casing downstream-side end plate and the edge on the radial outer side of the frame downstream-side end plate are connected to each other.

In the present aspect, the edge on the radial inner side of the casing downstream-side end plate and the edge on the radial outer side of the frame downstream-side end plate are connected to each other. Accordingly, the steam flowing to the radial inner side along the casing downstream-side end plate can be easily introduced into the exhaust auxiliary space via the opening in the portion on the non-exhaust side of the auxiliary exhaust frame.

In the exhaust chamber according to the aspect having the frame downstream-side end plate, an inner surface facing the exhaust auxiliary space in the frame downstream-side end plate and an inner surface facing the exhaust space in the casing downstream-side end plate may be smoothly continuous with each other in a portion where the frame downstream-side end plate and the casing downstream-side end plate are connected to each other.

In the present aspect, resistance can be minimized in a process of allowing the steam flowing to the radial inner side along the casing downstream-side end plate to flow into the exhaust auxiliary space via the opening in the portion on the non-exhaust side of the auxiliary exhaust frame.

The exhaust chamber according to any one of the above-described aspects having the frame downstream-side end plate may further include a second exhaust auxiliary space communicating with at least a portion on the non-exhaust side in the exhaust space, and forming a second auxiliary exhaust frame different from a first exhaust auxiliary space which is the exhaust auxiliary space, in addition to a first auxiliary exhaust frame which is the auxiliary exhaust frame. In this case, the exhaust casing has a casing outer peripheral plate that defines an edge on the radial outer side in the exhaust space. The second auxiliary exhaust frame has a second frame inner peripheral plate spreading in the circumferential direction at a position on the non-exhaust side with reference to the axis and on the radial inner side from the casing outer peripheral plate, and extending in the direction including the axial direction in which the axis extends from the casing downstream-side end plate. The second frame inner peripheral plate defines an edge on the radial inner side of the second exhaust auxiliary space. An edge on an axial upstream side opposite to the axial downstream side in the second frame inner peripheral plate defines an edge on the radial inner side of a second opening through which the exhaust space and the second exhaust auxiliary space communicate with each other.

In the present aspect, the steam inside the exhaust space and inside the region on the non-exhaust side with reference to the axis can be guided into the second exhaust auxiliary space. Therefore, in the present aspect, it is possible to reduce the circulation region in which the steam circulates inside the exhaust space and inside the region on the non-exhaust side with reference to the axis.

In the exhaust chamber according to the aspect including the second auxiliary exhaust frame, the second frame inner peripheral plate may gradually spread to the radial outer side toward the axial upstream side.

In the exhaust chamber according to any one of the above-described aspects including the second auxiliary exhaust frame, the second frame inner peripheral plate may extend toward the axial downstream side from an end on the radial outer side of the casing downstream-side end plate.

The second exhaust auxiliary space may be formed on the axial downstream side from the casing downstream-side end plate.

In the exhaust chamber according to any one of the above-described aspects including the second auxiliary exhaust frame, the second frame inner peripheral plate may extend toward the axial upstream side from a position on the radial inner side from an end on the radial outer side in the casing downstream-side end plate. The second exhaust auxiliary space may be formed on the axial upstream side from the casing downstream-side end plate.

In the exhaust chamber according to any one of the above-described aspects, within a circumferential region where the opening is present in the circumferential direction, an edge on the axial downstream side of the inner diffuser may define an edge on the axial upstream side opposite to the axial downstream side in the opening.

In the exhaust chamber according to the aspect in which the edge on the axial downstream side of the inner diffuser defines the edge on the axial upstream side in the opening, the auxiliary exhaust frame may have a frame upstream-side end plate that defines an edge on the axial upstream side in the exhaust auxiliary space. In this case, the frame upstream-side end plate has an annular shape around the axis. In addition, an edge on the radial outer side of the frame upstream-side end plate is connected to a portion that defines an edge on the axial upstream side of the opening, which is an edge on the axial downstream side of the inner diffuser.

In the exhaust chamber according to the aspect having the frame upstream-side end plate, an inner surface facing the exhaust auxiliary space in the frame upstream-side end plate may be a surface gradually facing the axial upstream side toward the radial inner side.

In the present aspect, a volume of the exhaust auxiliary space can be increased compared to a case where the position of the edge on the radial outer side of the frame upstream-side end plate in the axial direction is the same as the position of the edge on the radial inner side of the frame upstream-side end plate in the axial direction. Therefore, in the present aspect, even when the flow rate of the steam flowing to the radial inner side increases along the casing downstream-side end plate inside the exhaust space and inside the region on the non-exhaust side with reference to the axis, the steam can be introduced into the exhaust auxiliary space.

A flow directional component of the steam flowing inside the exhaust main flow path on the exhaust side with reference to the axis includes a directional component facing the axial downstream side. As described above, the inner surface facing the exhaust auxiliary space in the frame upstream-side end plate according to the present aspect gradually faces the axial upstream side as toward the radial inner side. In other words, the inner surface facing the exhaust auxiliary space in the frame upstream-side end plate according to the present aspect gradually faces the axial downstream side toward the radial outer side. Therefore, in the present aspect, the flow directional component of the steam flowing into the exhaust main flow path on the exhaust side with reference to the axis from the inside of the exhaust auxiliary space via the opening on the exhaust side includes the directional component facing the axial downstream side. Therefore, in the present aspect, it is possible to reduce an angle formed between the flow direction of the steam flowing into the exhaust main flow path on the exhaust side with reference to the axis from the inside of the exhaust auxiliary space via the opening on the exhaust side, and the flow direction of the steam flowing inside the exhaust main flow path on the exhaust side with reference to the axis. Therefore, in the present aspect, a flow turbulence of the steam flowing inside the exhaust main flow path on the exhaust side with reference to the axis decreases, and the pressure loss of the steam can be reduced.

In the exhaust chamber according to the aspect in which the edge on the axial downstream side of the inner diffuser defines the edge on the axial upstream side in the opening, the auxiliary exhaust frame may have a frame upstream-side end plate that defines an edge on the axial upstream side in the exhaust auxiliary space. In this case, the frame upstream-side end plate has an annular shape around the axis. In addition, an edge on the radial outer side of the frame upstream-side end plate is connected to the inner diffuser at a position on the axial upstream side from an edge on the axial upstream side of the opening.

In the present aspect, a volume of the exhaust auxiliary space can be increased, compared to a case where the edge on the radial outer side of the frame upstream-side end plate is connected to a portion that defines the edge on the axial downstream side of the opening, which is the edge on the axial upstream side of the inner diffuser. Therefore, in the present aspect, even when the flow rate of the steam flowing to the radial inner side increases along the casing downstream-side end plate inside the exhaust space and inside the region on the non-exhaust side with reference to the axis, the steam can be introduced into the exhaust auxiliary space.

A flow directional component of the steam flowing inside the exhaust main flow path on the exhaust side with reference to the axis includes a directional component facing the axial downstream side. In the present aspect, the edge on the radial outer side of the frame upstream-side end plate is connected to the inner diffuser at the position on the axial upstream side from the edge on the axial upstream side of the opening. Therefore, in the present aspect, a portion of the steam inside the exhaust auxiliary space flows along the inner peripheral surface of the inner diffuser. The inner peripheral surface of the inner diffuser gradually spreads to the axial downstream side toward the radial outer side. Therefore, a portion of the steam inside the exhaust auxiliary space flows to the axial downstream side toward the radial outer side. Therefore, in the present aspect, the flow directional component of the steam flowing into the exhaust main flow path on the exhaust side with reference to the axis from the inside of the exhaust auxiliary space via the opening on the exhaust side includes the directional component facing the axial downstream side. Therefore, in the present aspect, it is possible to reduce an angle formed between the flow direction of the steam flowing into the exhaust main flow path on the exhaust side with reference to the axis from the inside of the exhaust auxiliary space via the opening on the exhaust side, and the flow direction of the steam flowing inside the exhaust main flow path on the exhaust side with reference to the axis. Therefore, in the present aspect, a flow turbulence of the steam flowing inside the exhaust main flow path on the exhaust side with reference to the axis decreases, and the pressure loss of the steam can be reduced.

In the exhaust chamber of the steam turbine according to any one of the above-described aspects, the opening may have an annular shape with reference to the axis.

According to an aspect of the invention, in order to achieve the above-described object, there is provided a steam turbine.

The steam turbine includes the exhaust chamber according to any one of the above-described aspects, the steam turbine rotor, a cylinder casing that covers an outer peripheral side of the steam turbine rotor, and a stator blade row disposed on an inner peripheral side of the cylinder casing, and in which an end on the radial outer side is attached to the cylinder casing. The outer diffuser is connected to the cylinder casing.

Advantageous Effects of Invention

In the exhaust chamber according to an aspect of the present invention, the pressure recovery amount can be increased by reducing the pressure loss of the steam.

DESCRIPTION OF EMBODIMENTS

Hereinafter, various embodiments of a steam turbine including an exhaust chamber according to the present invention will be described in detail with reference to the drawings.

First Embodiment

A first embodiment of the steam turbine according to the present invention will be described with reference to FIGS. 1 to 5.

Figure 1:
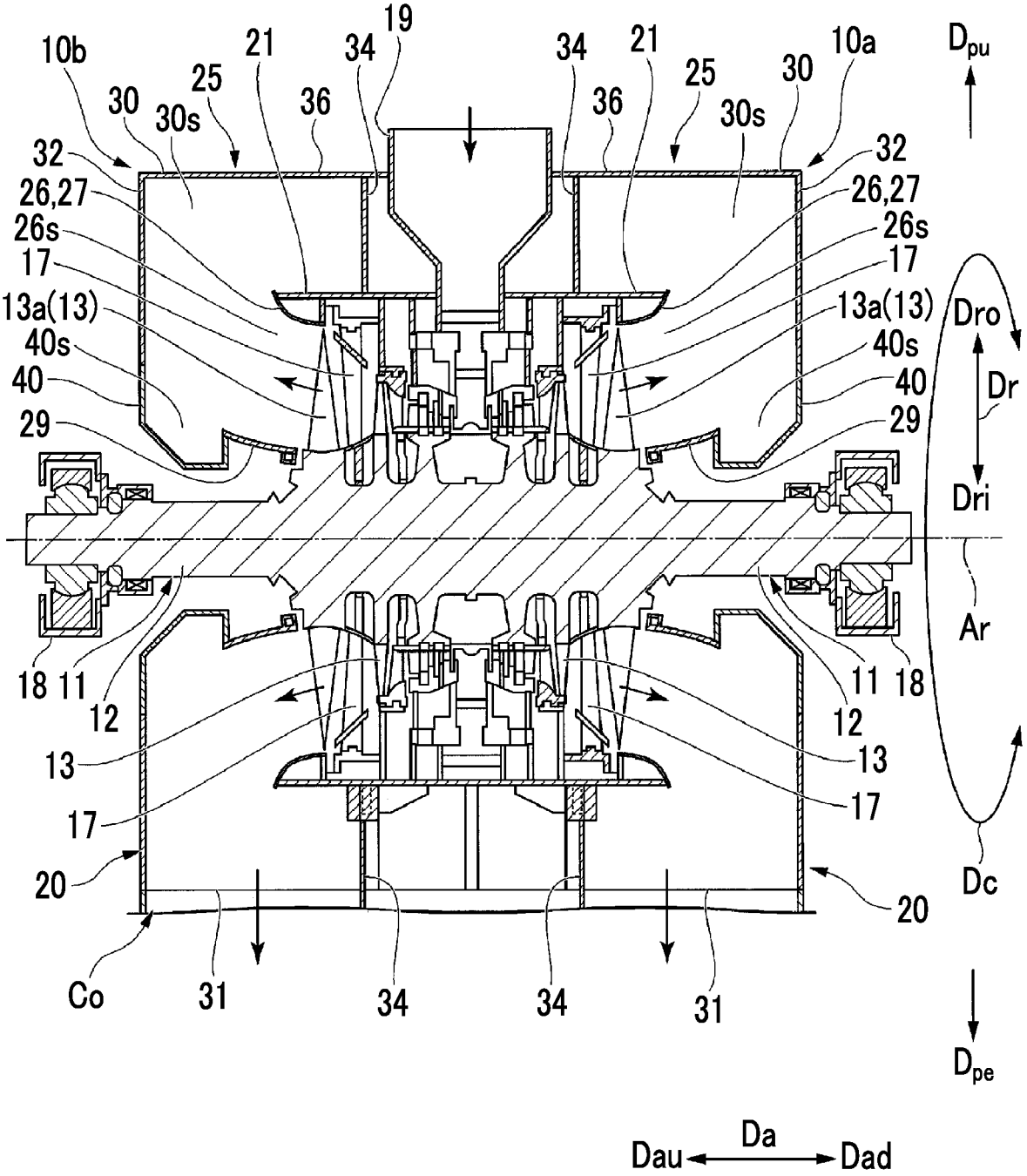
FIG. 1 is an overall sectional view of a steam turbine according to a first embodiment of the present invention.

The steam turbine of the first embodiment is a two-way exhaust type steam turbine. Therefore, as illustrated in FIG. 1, the steam turbine includes a first steam turbine unit 10*a* and a second steam turbine unit 10*b*. Both the first steam turbine unit 10*a* and the second steam turbine unit 10*b* have a turbine rotor 11 rotating around an axis Ar, a casing 20 that covers the turbine rotor 11, a plurality of stator blade rows 17 fixed to the casing 20, and a steam inlet duct 19. Hereinafter, a circumferential direction around the axis Ar will be simply referred to as a circumferential direction Dc, and a radial direction with respect to the axis Ar will be referred to as a radial direction Dr. Furthermore, a side closer to the axis Ar in the radial direction Dr will be referred to as a radial inner side Dri, and a side opposite thereto will be referred to as a radial outer side Dro.

The first steam turbine unit 10*a* and the second steam turbine unit 10*b* share a steam inlet duct 19. Components of the first steam turbine unit 10*a* excluding the steam inlet duct 19 are disposed on one side in an axial direction Da with reference to the steam inlet duct 19. In addition, components of second steam turbine unit 10*b* excluding the steam inlet duct 19 are disposed on the other side in the axial direction Da with reference to the steam inlet duct 19. In each of the steam turbine units 10*a* and 10*b*, a side of the steam inlet duct 19 is the axial direction Da will be referred to as an axial upstream side Dau, and a side opposite thereto will be referred to as an axial downstream side Dad.

A configuration of the first steam turbine unit 10*a* and a configuration of the second steam turbine unit 10*b* are basically the same as each other. Therefore, hereinafter, the first steam turbine unit 10*a* will be mainly described.

The turbine rotor 11 has a rotor shaft 12 extending in the axial direction Da around the axis Ar, and a plurality of rotor blade rows 13 attached to the rotor shaft 12. The turbine rotor 11 is supported to be rotatable around the axis Ar by a bearing 18. The plurality of rotor blade rows 13 are aligned in the axial direction Da. Each of the rotor blade rows 13 is configured to include a plurality of rotor blades aligned in the circumferential direction Dc. The turbine rotor 11 of the first steam turbine unit 10*a* and the turbine rotor 11 of the second steam turbine unit 10*b* are located on the same axis Ar, are connected to each other, and integrally rotate around the axis Ar.

The casing 20 has a cylinder casing 21 and an exhaust chamber 25. The cylinder casing 21 forms a substantially conical space around the axis Ar, and covers an outer periphery of the turbine rotor 11. The plurality of rotor blade rows 13 of the turbine rotor 11 are disposed in the conical space. The plurality of stator blade rows 17 are aligned along the axial direction Da, and are disposed inside the conical space. Each of the plurality of stator blade rows 17 is disposed on the axial upstream side Dau of any one rotor blade row 13 of the plurality of rotor blade rows 13. The plurality of stator blade rows 17 are fixed to the cylinder casing 21.

Figure 2:
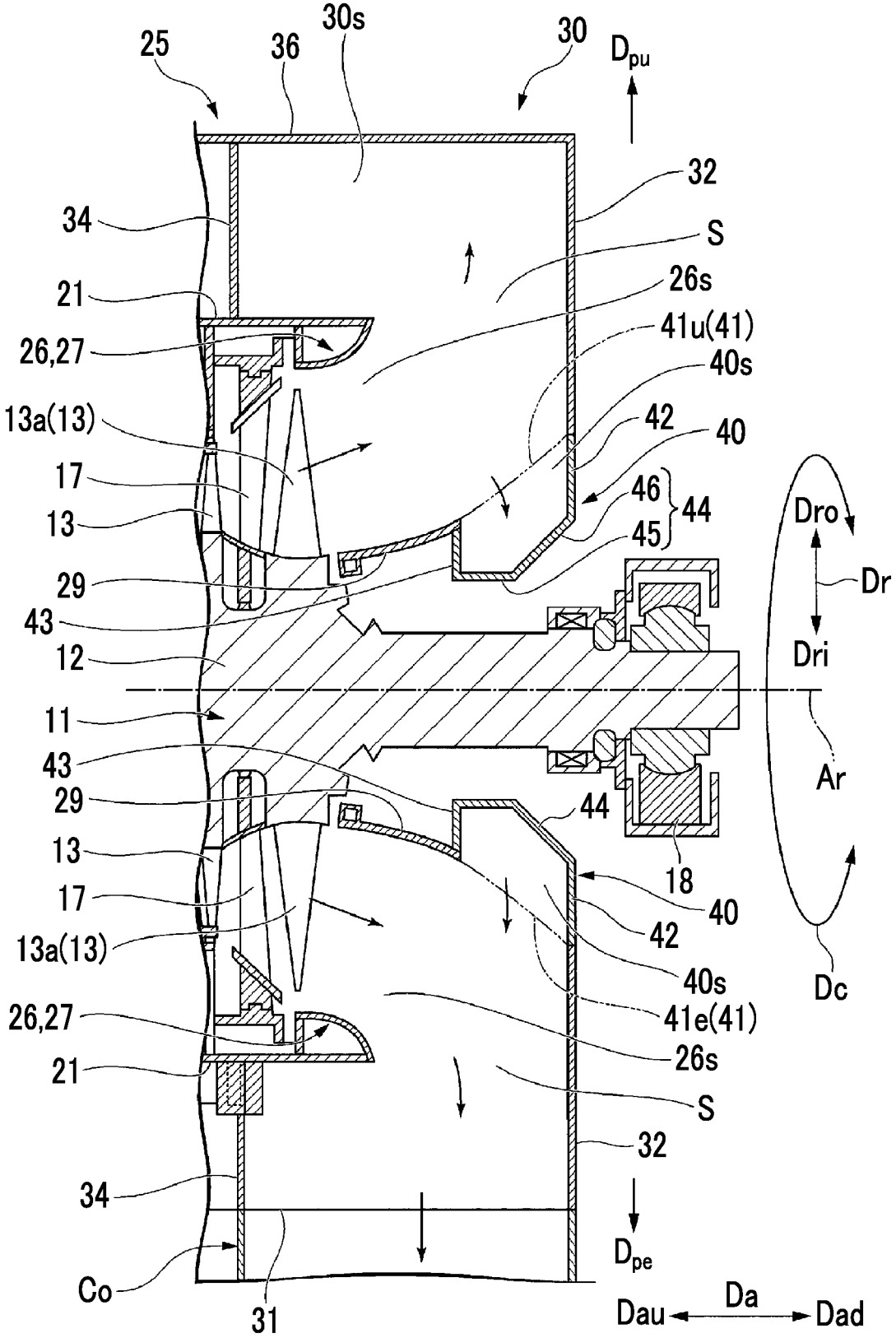
FIG. 2 is a sectional view of a main part of the steam turbine according to the first embodiment of the present invention.

As illustrated in FIG. 2, the exhaust chamber 25 has a diffuser 26, an exhaust casing 30, and an auxiliary exhaust frame 40.

The diffuser 26 has an annular shape with respect to the axis Ar, and forms a diffuser space 26*s* gradually facing the radial outer side Dro toward the axial downstream side Dad. The steam flowing out from the last stage rotor blade row 13*a* of the turbine rotor 11 flows into the diffuser space 26*s*. The last stage rotor blade row 13*a* is the rotor blade row 13 disposed on the most axial downstream side Dad, out of the plurality of rotor blade rows 13. The diffuser 26 has an outer diffuser (or steam guide, flow guide) 27 that defines an edge on the radial outer side Dro of the diffuser space 26*s*, and an inner diffuser (or bearing cone) 29 that defines an edge on the radial inner side Dri of the diffuser space 26*s*. The outer diffuser 27 has an annular cross section perpendicular to the axis Ar, and gradually spreads to the radial outer side Dro toward the axial downstream side Dad. The inner diffuser 29 also has an annular cross section perpendicular to the axis Ar, and gradually spreads toward the radial outer side Dro toward the axial downstream side Dad. The outer diffuser 27 is connected to the cylinder casing 21.

The exhaust casing 30 has an exhaust port 31. The exhaust port 31 is open to the radial outer side Dro from the inside in a vertically downward direction. A condenser Co that returns steam to water is connected to the exhaust port 31. Therefore, the steam turbine of the present embodiment is a downward exhaust type condensing steam turbine. Here, a non-exhaust side Dpu and an exhaust side Dpe form mutually opposite sides with reference to the axis Ar in an orthogonal direction orthogonal to the axis Ar. The steam turbine of the present embodiment is the downward exhaust type condensing steam turbine as described above. Accordingly, the exhaust side Dpe is a vertically lower side, and the non-exhaust side Dpu is a vertical upper side.

The exhaust casing 30 forms an exhaust space 30*s* communicating with the diffuser 26. The exhaust space 30*s* has an outer periphery of the diffuser 26 which spreads in the circumferential direction Dc with respect to the axis Ar, and guides the steam flowing from the diffuser space 26*s* to the exhaust port 31. The exhaust casing 30 has a casing downstream-side end plate 32, a casing upstream-side end plate 34, and a casing outer peripheral plate 36.

The casing downstream-side end plate 32 defines an edge on the axial downstream side Dad of the exhaust space 30*s*. The casing downstream-side end plate 32 spreads in a direction including a component in the radial direction Dr and in the circumferential direction Dc, and is substantially perpendicular to the axis Ar. A portion above the axis Ar in the casing downstream-side end plate 32 has a substantially semicircular shape. On the other hand, a portion below the axis Ar in the casing downstream-side end plate 32 has a substantially rectangular shape. However, the casing downstream-side end plate 32 has a circular opening formed around the axis Ar. An edge on the circular opening forms an edge on the radial inner side Dri of the casing downstream-side end plate 32. A lower edge on the casing downstream-side end plate 32 forms a portion of an edge on the exhaust port 31.

The casing outer peripheral plate 36 defines an edge on the radial outer side Dro of the exhaust space 30*s*. The casing outer peripheral plate 36 is connected to an edge on the radial outer side Dro of the casing downstream-side end plate 32, spreads in the axial direction Da, and spreads in the circumferential direction Dc around the axis Ar. The casing outer peripheral plate 36 has a semi-circular shape (semi-cylindrical shape) whose upper side forms a semi-cylinder. An edge on the axial downstream side Dad of the casing outer peripheral plate 36 is connected to the casing downstream-side end plate 32. In addition, a lower edge on the casing outer peripheral plate 36 forms a portion of an edge on the exhaust port 31.

The casing upstream-side end plate 34 defines an edge on the axial upstream side Dau of the exhaust space 30*s*. The casing upstream-side end plate 34 is disposed on the axial upstream side Dau from the diffuser 26. The casing upstream-side end plate 34 spreads to the radial outer side Dro from an outer peripheral surface 21*o* of the cylinder casing 21. The casing upstream-side end plate 34 is substantially perpendicular to the axis Ar. Therefore, the casing upstream-side end plate 34 faces the casing downstream-side end plate 32 at an interval therebetween in the axial direction Da. A lower edge on the casing upstream-side end plate 34 forms a portion of the edge on the exhaust port 31. In an edge on the radial outer side Dro of the casing upstream-side end plate 34, a portion excluding a portion forming the edge on the exhaust port 31 is connected to the casing outer peripheral plate 36.

As illustrated in FIG. 1, the exhaust casing 30 of the first steam turbine unit 10*a* and the exhaust casing 30 of the second steam turbine unit 10*b* are connected to and integrated with each other.

Figure 3:
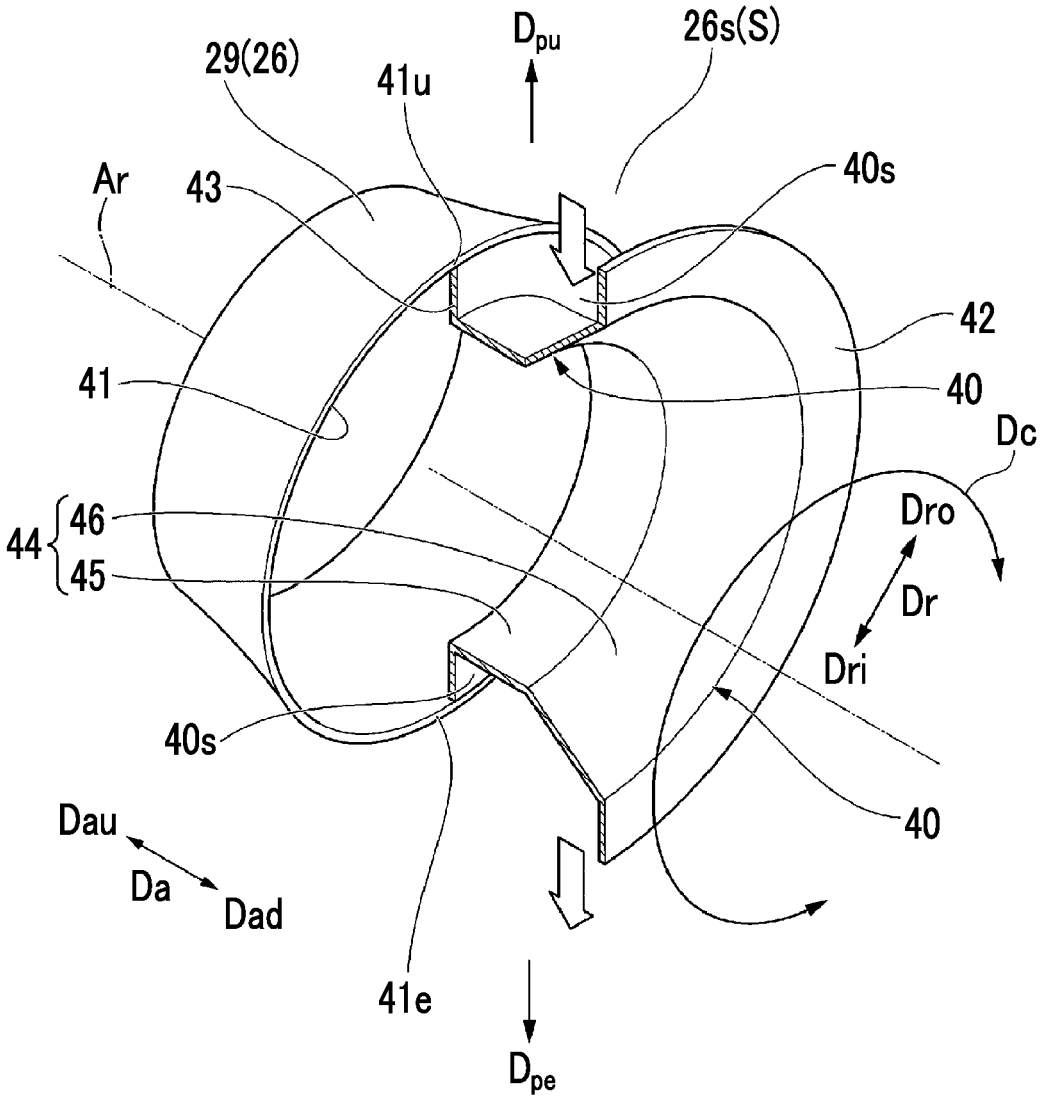
FIG. 3 is a perspective view of an inner diffuser and an auxiliary exhaust frame according to the first embodiment of the present invention.

As illustrated in FIGS. 2 and 3, the auxiliary exhaust frame 40 includes a partial region on the radial inner side Dri from the diffuser 26, and forms an exhaust auxiliary space 40*s* having an annular shape around the axis Ar.

The auxiliary exhaust frame 40 has an opening 41 open toward the radial outer side Dro from the inside of the exhaust auxiliary space 40*s*, and through which the exhaust space 30*s* and the exhaust auxiliary space 40*s* communicate with each other. The opening 41 is has an annular shape around the axis Ar. An edge on the axial upstream side Dau of the opening 41 is defined by an edge on the axial downstream side Dad of the inner diffuser 29. Hereinafter, in the opening 41, a portion facing vertically upward from the inside of the exhaust auxiliary space 40*s* will be referred to as a non-exhaust side opening portion 41*u*, and a portion facing vertically downward from the inside of the exhaust auxiliary space 40*s* will be referred to as an exhaust side opening portion 41*e*.

The auxiliary exhaust frame 40 has a frame downstream-side end plate 42, a frame upstream-side end plate 43, and a frame inner peripheral plate 44.

The frame downstream-side end plate 42 defines an edge on the axial downstream side Dad in the exhaust auxiliary space 40*s*. The frame downstream-side end plate 42 is an annular plate spreading in the direction including the component in the radial direction Dr and in the circumferential direction Dc. The edge on the radial outer side Dro of the frame downstream-side end plate 42 is connected to the edge on the radial inner side Dri of the casing downstream-side end plate 32. An inner surface facing the exhaust auxiliary space 40*s* in the frame downstream-side end plate 42 and an inner surface facing the exhaust space 30*s* in the casing downstream-side end plate 32 are smoothly continuous with a portion where the frame downstream-side end plate 42 and the casing downstream-side end plate 32 are connected to each other. In the present embodiment, both the inner surface facing the exhaust auxiliary space 40*s* in the frame downstream-side end plate 42 and the inner surface facing the exhaust space 30*s* in the casing downstream-side end plate 32 are surfaces spreading in the radial direction Dr and the circumferential direction Dc, and are connected to be flush with each other. Therefore, the inner surface facing the exhaust auxiliary space 40*s* in the frame downstream-side end plate 42 and the inner surface facing the exhaust space 30*s* in the casing downstream-side end plate 32 are located one virtual plane spreading in the radial direction Dr and the circumferential direction Dc.

The edge on the axial downstream side Dad of the opening 41 is defined by the edge on the radial outer side Dro of the frame downstream-side end plate 42.

The frame upstream-side end plate 43 defines the edge on the axial upstream side Dau in the exhaust auxiliary space 40*s*. The frame upstream-side end plate 43 is an annular plate spreading in the radial direction Dr and the circumferential direction Dc. The edge on the radial outer side Dro of the frame upstream-side end plate 43 is connected to the edge on the axial downstream side Dad of the inner diffuser 29, that is, a portion of the inner diffuser 29 which defines the edge on the axial upstream side Dau of the opening 41.

The frame inner peripheral plate 44 defines the edge on the radial inner side Dri in the exhaust auxiliary space 40*s*. The frame inner peripheral plate 44 connects the edge on the radial inner side Dri of the frame upstream-side end plate 43 and the edge on the radial inner side Dri of the frame downstream-side end plate 42. The frame inner peripheral plate 44 has an upstream-side inner peripheral plate 45 and a downstream-side inner peripheral plate 46. The upstream-side inner peripheral plate 45 has an annular shape around the axis Ar, and extends in the axial direction Da. The edge on the axial upstream side Dau of the upstream-side inner peripheral plate 45 is connected to the edge on the radial inner side Dri of the frame upstream-side end plate 43. The downstream-side inner peripheral plate 46 has an annular shape around the axis Ar, and gradually extends to the radial outer side Dro toward the axial downstream side Dad. The edge on the axial upstream side Dau of the downstream-side inner peripheral plate 46 is connected to the edge on the axial downstream side Dad of the upstream-side inner peripheral plate 45. The edge on the axial downstream side Dad of the downstream-side inner peripheral plate 46 is connected to the edge on the radial inner side Dri of the frame downstream-side end plate 42.

Figure 5:
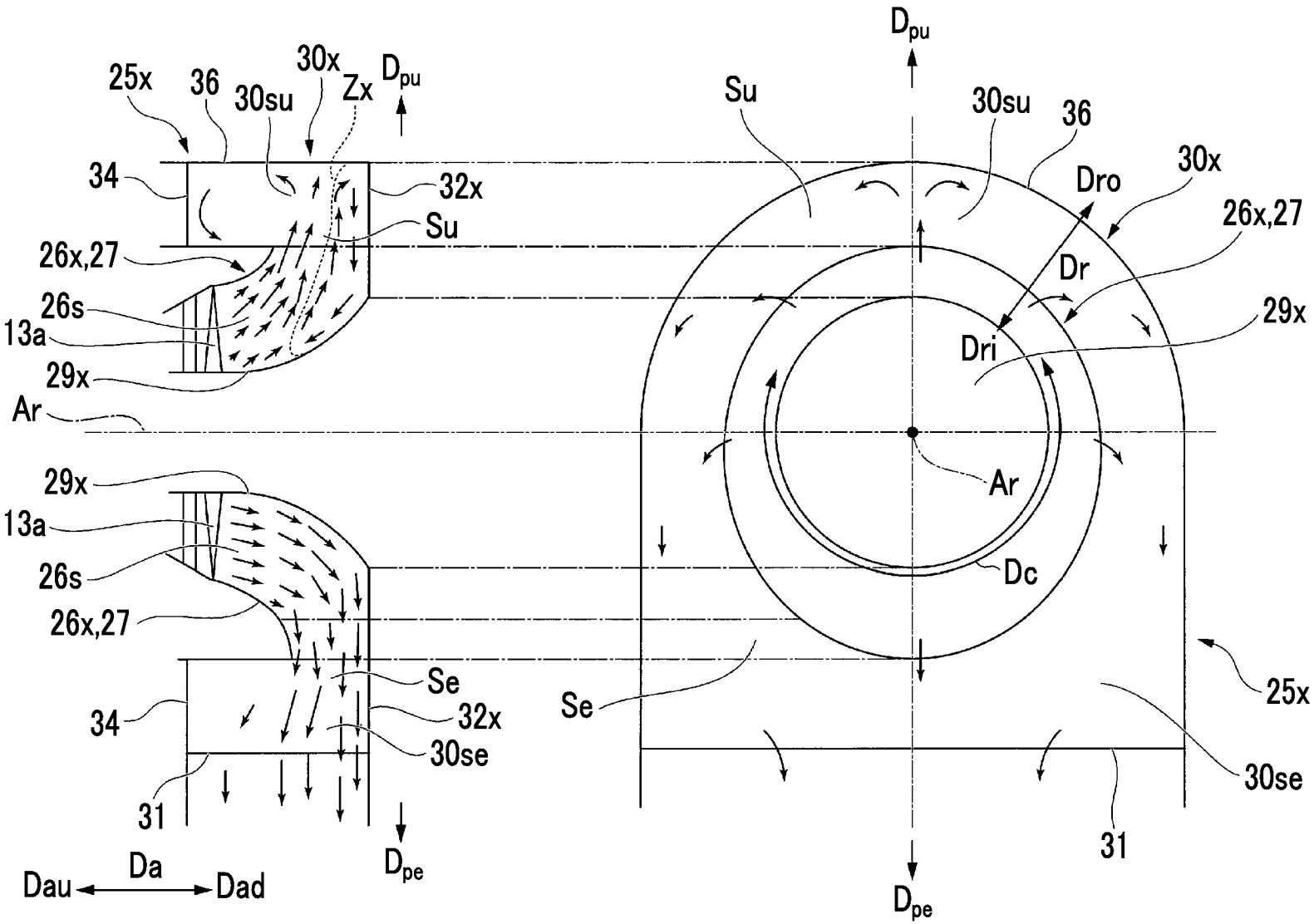
FIG. 5 is a view for describing a steam flow inside an exhaust chamber according to a comparative example.

Next, before an advantageous effect of the exhaust chamber 25 is described, an exhaust chamber of a comparative example will be described with reference to FIG. 5.

The exhaust chamber 25*x* of the comparative example has a diffuser 26*x* and an exhaust casing 30*x*, as in the exhaust chamber 25 of the present embodiment. However, the exhaust chamber 25*x* of the comparative example does not have the auxiliary exhaust frame 40 of the exhaust chamber 25 in the present embodiment. The diffuser 26*x* of the comparative example has the outer diffuser 27 and an inner diffuser 29*x*, as in the diffuser 26 of the present embodiment. However, since the exhaust chamber 25*x* of the comparative example does not have the auxiliary exhaust frame 40, the openings 41*u* and 41*e* of the present embodiment are not formed in the inner diffuser 29*x* of the comparative example. As in the exhaust casing 30 of the present embodiment, the exhaust casing 30*x* of the comparative example has a casing downstream-side end plate 32*x*, the casing upstream-side end plate 34, and the casing outer peripheral plate 36. An edge on the axial downstream side Dad of the inner diffuser 29*x* of the comparative example is connected to the casing downstream-side end plate 32*x*.

As a result of analyzing a steam flow inside the exhaust chamber 25*x* of the comparative example, it was found that the steam flows inside the exhaust chamber 25*x* as follows.

The steam flowing out from the last stage rotor blade row 13*a* of the turbine rotor to the axial downstream side Dad flows into the diffuser space 26*s*. While the steam flows toward the axial downstream side Dad inside the diffuser space 26*s*, the steam flows toward the radial outer side Dro, and flows into the exhaust space 30*s*.

Inside the exhaust space 30*s* and in a region on the non-exhaust side Dpu (hereinafter, referred to as a non-exhaust side exhaust space 30*su*) with reference to the axis Ar, the steam flowing into the exhaust space 30*s* along the inner peripheral surface of the outer diffuser 27 flows in an extending direction of a tangent line in an end on the radial outer side Dro of the inner peripheral surface of the outer diffuser 27, that is, in a tangential direction. When the steam collides with the casing outer peripheral plate 36, a portion of the steam flows to the axial upstream side Dau along the casing outer peripheral plate 36, and a portion of the steam flows to the axial downstream side Dad along the casing outer peripheral plate 36.

The steam flowing to the axial upstream side Dau along the casing outer peripheral plate 36 gradually changes a flow direction to the circumferential direction Dc, and flows to the exhaust side Dpe along the casing outer peripheral plate 36. Then, the steam is exhausted from the exhaust port 31. On the other hand, the steam flowing to the axial downstream side Dad along the casing outer peripheral plate 36 flows to a base portion side of the last stage rotor blade row 13*a* along the casing downstream-side end plate 32*x* and the inner diffuser 29*x*. That is, the steam flowing to the axial downstream side Dad along the casing outer peripheral plate 36 flows to the radial inner side Dri along the casing downstream-side end plate 32*x*. Furthermore, while the steam flows toward the radial inner side Dri along the inner peripheral surface of the inner diffuser 29, the steam flows to the axial upstream side Dau. Therefore, steam flows back in a region along the casing downstream-side end plate 32*x* inside the exhaust space 30*s* and in a region along the inner diffuser 29*x* inside the diffuser space 26*s*. The steam flowing back inside the diffuser space 26*s* flows close to the outer diffuser 27 side, and flows again to the radial outer side Dro. Therefore, a circulation region Zx in which the steam circulates is formed inside the exhaust main flow path S and inside a region on the non-exhaust side Dpu (hereinafter, referred to as a non-exhaust side main flow path Su) with reference to the axis Ar. The exhaust main flow path S is a space in which the diffuser space 26*s* and the exhaust space 30*s* are combined with each other.

On the other hand, inside the exhaust space 30*s* and inside a region on the exhaust side Dpe with reference to the axis Ar (hereinafter, referred to as an exhaust side exhaust space 30*se*), a flow direction of the steam flowing into the exhaust space 30*s* along the inner peripheral surface of the outer diffuser 27 is a direction including a component in the tangential direction in which the tangential line extends in the end on the radial outer side Dro of the inner peripheral surface and a directional component on a side closer to the exhaust port 31 in the circumferential direction Dc with respect to the axis Ar. The reason is as follows. The steam containing a large amount of the component in the circumferential direction Dc flows into a region on the exhaust side Dpe from a region on the non-exhaust side Dpu inside the exhaust chamber 25*x*. In addition, the above-described tangential direction includes a directional component facing the radial outer side Dro. Inside the exhaust side exhaust space 30*se*, the exhaust port 31 is formed on the radial outer side Dro. Therefore, inside the exhaust main flow path S and in a region on the exhaust side Dpe with reference to the axis Ar (hereinafter, referred to as an exhaust side main flow path Se), the backflow of the steam is not substantially generated as in the region on the non-exhaust side Dpu.

As described above, in the comparative example, a portion of a cross-sectional area of the flow path inside the exhaust main flow path S cannot be effectively used to exhaust the steam. Consequently, the pressure loss of the steam increases.

In a case of a low load operation having a low flow rate of the steam flowing into the steam turbine, or in a case of low vacuum inside the condenser Co, with regard to a directional component in the flow direction of the steam flowing out from the last stage rotor blade row 13*a* of the turbine rotor, a component in the circumferential direction Dc around the axis Ar, that is, a turning component is relatively larger than a directional component toward the axial downstream side Dad. Therefore, in this case, the steam flowing out from the last stage rotor blade row 13*a* of the turbine rotor has a strong tendency to be deflected to the radial outer side Dro inside the diffuser space 26*s*. Therefore, in the steam flowing into the diffuser space 26*s*, the flow rate of the steam on the outer diffuser 27 side is higher than the flow rate of the steam on the inner diffuser 29*x* side. That is, in the case of the low load operation or in the case of low vacuum inside the condenser Co, the flow of the steam flowing along the inner peripheral surface of the outer diffuser 27 increases. Therefore, in the comparative example, in the case of the low load operation or in the case of low vacuum inside the condenser Co, the amount of steam flowing back inside the exhaust chamber 25*x* further increases, and the pressure loss of the steam increases.

Next, an advantageous effect of the exhaust chamber 25 in the present embodiment described above will be described with reference to FIG. 4.

As a result of analyzing the flow of the steam inside the exhaust chamber 25 in the present embodiment, it was found that the steam flows inside the exhaust chamber 25 as follows.

In the present embodiment, the steam flowing out from the last stage rotor blade row 13*a* of the turbine rotor to the axial downstream side Dad also flows into the diffuser space 26*s*, as in the comparative example. While the steam flows toward the axial downstream side Dad inside the diffuser space 26*s*, the steam flows toward the radial outer side Dro, and flows into the exhaust space 30*s*.

As in the comparative example, inside the non-exhaust side exhaust space 30*su*, the steam flowing into the non-exhaust side exhaust space 30*su* along the inner peripheral surface of the outer diffuser 27 flows in the extending direction of the tangent line in the end of the radial outer side Dr on the inner peripheral surface of the outer diffuser 27, that is, in the tangential direction. When the steam collides with the casing outer peripheral plate 36, a portion of the steam flows to the axial upstream side Dau along the casing outer peripheral plate 36, and a portion of the steam flows to the axial downstream side Dad along the casing outer peripheral plate 36.

The steam flowing to the axial upstream side Dau along the casing outer peripheral plate 36 gradually changes a flow direction to the circumferential direction Dc, and flows to the exhaust side Dpe along the casing outer peripheral plate 36. Then, the steam is exhausted from the exhaust port 31. On the other hand, the steam flowing to the axial downstream side Dad along the casing outer peripheral plate 36 flows to the radial inner side Dri along the casing downstream-side end plate 32.

Incidentally, the pressure inside the exhaust auxiliary space 40*s* is higher than the pressure inside the exhaust side main flow path Se. Therefore, the fluid inside the exhaust auxiliary space 40*s* flows into the exhaust side main flow path Se via the exhaust side opening portion 41*e* of the auxiliary exhaust frame 40. In addition, the pressure inside the non-exhaust side main flow path Su is higher than the pressure inside the exhaust auxiliary space 40*s*. Therefore, a portion of the steam inside the non-exhaust side main flow path Su enters the inside of the exhaust auxiliary space 40*s* via the non-exhaust side opening portion 41*u* of the auxiliary exhaust frame 40.

Therefore, in the present embodiment, as described above, even when the steam flowing to the radial inner side Dri is generated along the casing downstream-side end plate 32 inside the non-exhaust side main flow path Su, that is, even when the backflow of the steam is generated, the steam enters the inside of the exhaust auxiliary space 40*s* via the non-exhaust side opening portion 41*u* of the auxiliary exhaust frame 40. Then, as described above, the steam flows into the exhaust side main flow path Se via the exhaust side opening portion 41*e* of the auxiliary exhaust frame 40, and is exhausted from the exhaust port 31.

In the present embodiment, the non-exhaust side opening portion 41*u* of the auxiliary exhaust frame 40 is open toward the radial outer side Dro from the inside of the exhaust auxiliary space 40*s*. Therefore, in the present embodiment, the steam flowing to the radial inner side Dri along the casing downstream-side end plate 32 inside the non-exhaust side exhaust space 30*su* is likely to flow into the exhaust auxiliary space 40*s* via the non-exhaust side opening portion 41*u* of the auxiliary exhaust frame 40. In addition, in the present embodiment, an edge on the radial outer side Dro of the frame downstream-side end plate 42 in the auxiliary exhaust frame 40 is connected to an edge on the radial inner side Dri of the casing downstream-side end plate 32 in the exhaust casing 30. Moreover, in the present embodiment, an inner surface facing the exhaust auxiliary space 40*s* in the frame downstream-side end plate 42 and an inner surface facing the exhaust space 30*s* in the casing downstream-side end plate 32 are smoothly continuous with a portion where the frame downstream-side end plate 42 and the casing downstream-side end plate 32 are connected to each other. Therefore, in the present embodiment, resistance in a process in which the steam flowing to the radial inner side Dri along the casing downstream-side end plate 32 inside the non-exhaust side exhaust space 30*su* enters the inside of the exhaust auxiliary space 40*s* can be minimized. In the present embodiment, from a viewpoint described above, the steam flowing to the radial inner side Dri along the casing downstream-side end plate 32 inside the non-exhaust side main flow path Su can easily flow into the exhaust auxiliary space 40*s* via the non-exhaust side opening portion 41*u* of the auxiliary exhaust frame 40.

In the present embodiment, the backflow of the steam is not substantially generated inside the exhaust side main flow path Se, as in the comparative example.

As described above, in the present embodiment, a portion of the steam flowing back inside the exhaust main flow path S can flow into the exhaust auxiliary space 40*s*. Therefore, in the present embodiment, the circulation region Z in which the steam flows back inside the exhaust main flow path S decreases than that in the comparative example, and the circulation region Z is limited within a region on to the radial outer side Dro inside the exhaust main flow path S. Therefore, in the present embodiment, the pressure loss of the steam decreases than that of the comparative example, and the pressure recovery amount of the steam inside the exhaust main flow path S can be improved.

Second Embodiment

A second embodiment of the steam turbine according to the present invention will be described with reference to FIGS. 6 to 8.

The steam turbine of the present embodiment is different from the steam turbine of the first embodiment only in a configuration of an exhaust chamber. Therefore, hereinafter, the exhaust chamber according to the present embodiment will be mainly described.

Figure 6:
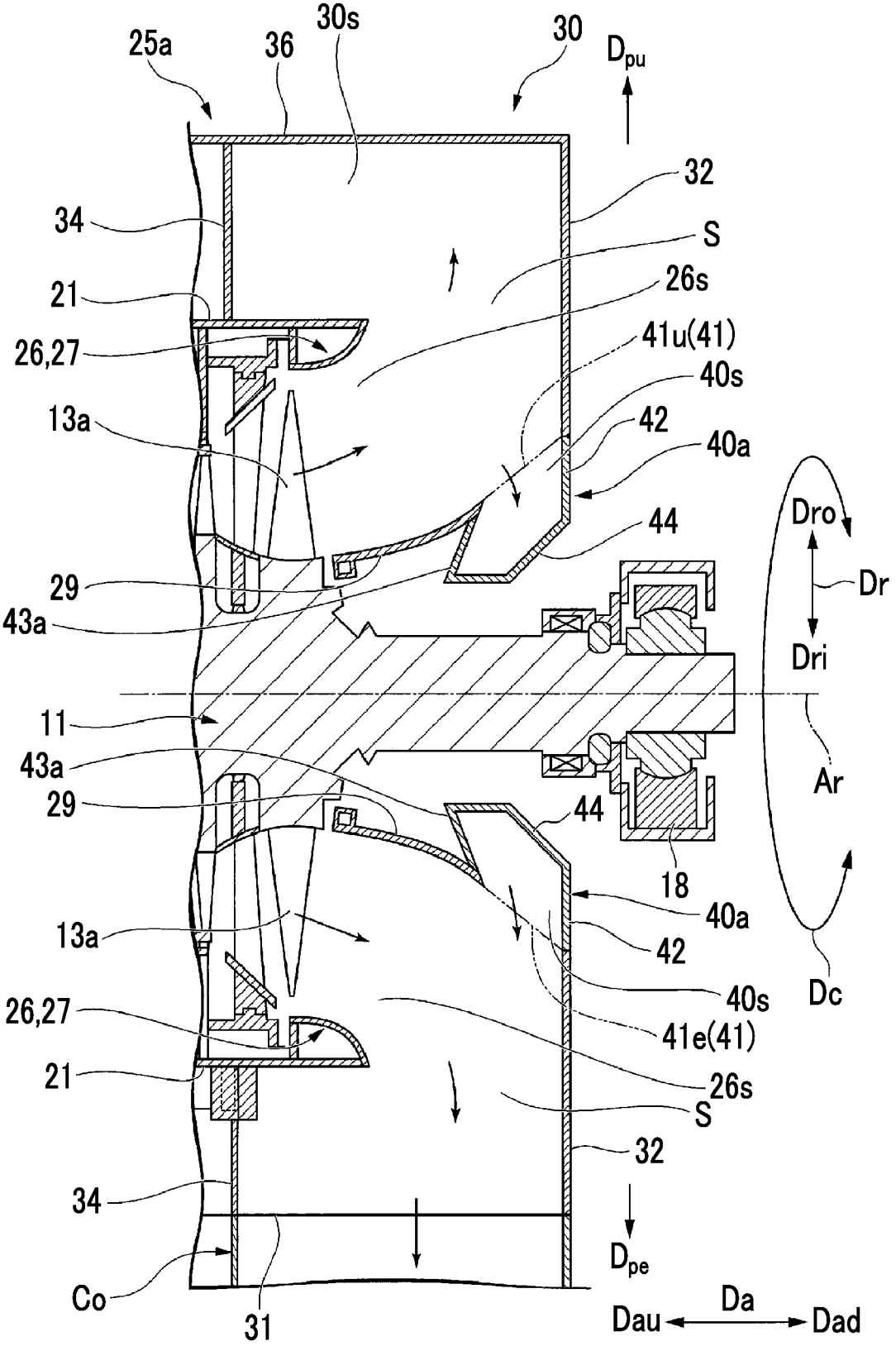
FIG. 6 is a sectional view of a main part of a steam turbine according to a second embodiment of the present invention.
Figure 7:
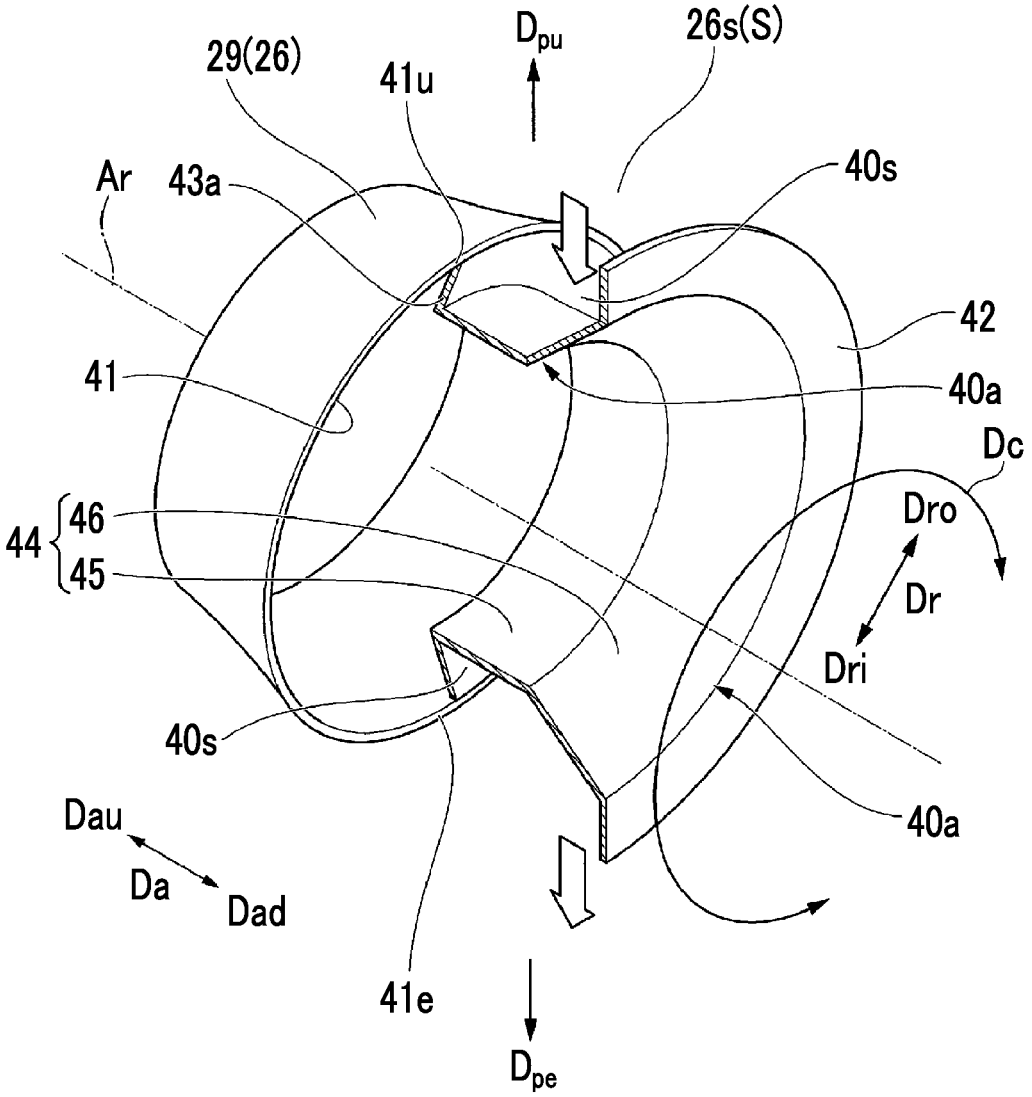
FIG. 7 is a perspective view of an inner diffuser and an auxiliary exhaust frame according to the second embodiment of the present invention.
Figure 8:
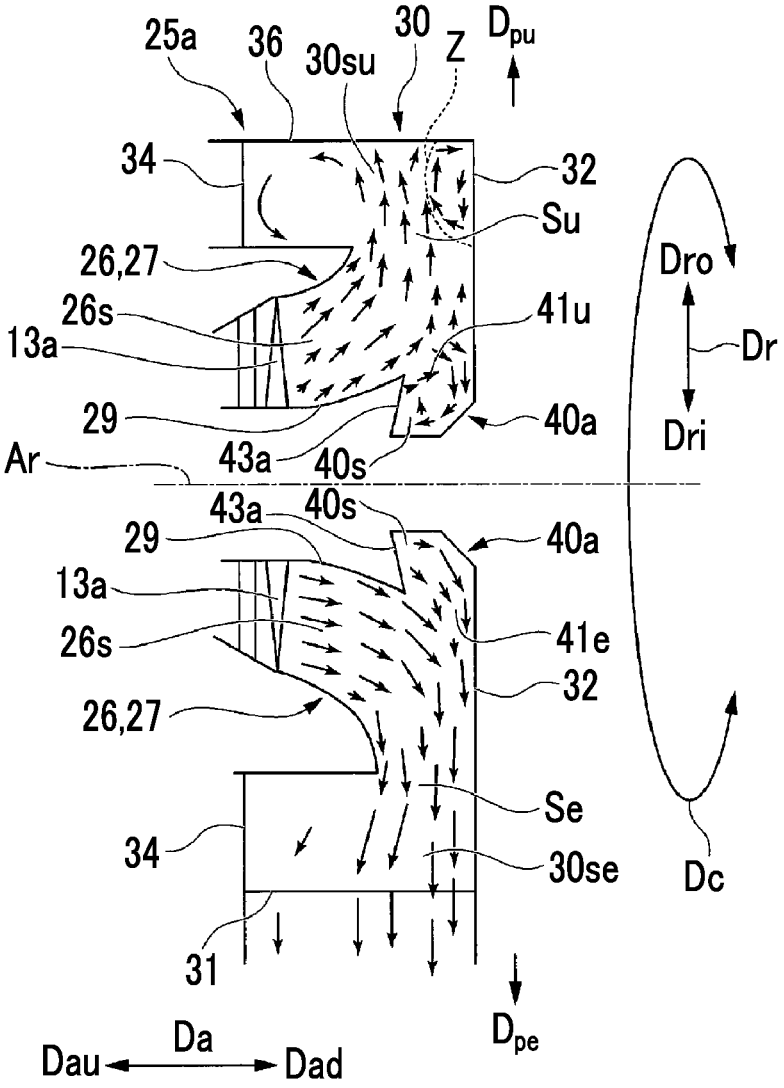
FIG. 8 is a view for describing a steam flow inside an exhaust chamber according to the second embodiment of the present invention.

As illustrated in FIGS. 6 and 7, an exhaust chamber 25*a* in the present embodiment has the diffuser 26, the exhaust casing 30, and an auxiliary exhaust frame 40*a*, as in the exhaust chamber 25 in the first embodiment. The diffuser 26 in the present embodiment is basically the same as the diffuser 26 in the first embodiment. In addition, the exhaust casing 30 in the present embodiment is basically the same as the exhaust casing 30 in the first embodiment. However, the auxiliary exhaust frame 40*a* in the present embodiment is different from the auxiliary exhaust frame 40 in the first embodiment.

As in the auxiliary exhaust frame 40 in the first embodiment, the auxiliary exhaust frame 40*a* in the present embodiment includes a partial region on the radial inner side Dri from the diffuser 26, and forms the exhaust auxiliary space 40*s* having an annular shape around the axis Ar.

As in the auxiliary exhaust frame 40 in the first embodiment, the auxiliary exhaust frame 40*a* has the opening 41 open toward the radial outer side Dro from the inside of the exhaust auxiliary space 40*s*, and through which the exhaust space 30*s* and the exhaust auxiliary space 40*s* communicate with each other. The opening 41 in the present embodiment has the annular shape around the axis Ar. An edge on the axial upstream side Dau of the opening 41 is defined by an edge on the axial downstream side Dad of the inner diffuser 29. In the opening 41, the portion facing vertically upward from the inside of the exhaust auxiliary space 40*s* is the non-exhaust side opening portion 41*u*, and the portion facing vertically downward from the inside of the exhaust auxiliary space 40*s* is the exhaust side opening portion 41*e*.

As in the auxiliary exhaust frame 40 in the first embodiment, the auxiliary exhaust frame 40*a* in the present embodiment has the frame downstream-side end plate 42, the frame upstream-side end plate 43*a*, and the frame inner peripheral plate 44.

The frame downstream-side end plate 42 defines an edge on the axial downstream side Dad in the exhaust auxiliary space 40*s*. The frame downstream-side end plate 42 is the same as the frame downstream-side end plate 42 in the first embodiment, and is an annular plate spreading in the direction including the component in the radial direction Dr and in the circumferential direction Dc. The edge on the radial outer side Dro of the frame downstream-side end plate 42 is connected to the edge on the radial inner side Dri of the casing downstream-side end plate 32.

The frame upstream-side end plate 43*a* defines an edge on the axial upstream side Dau in the exhaust auxiliary space 40*s*. As in the frame upstream-side end plate 43 in the first embodiment, the frame upstream-side end plate 43*a* is an annular plate spreading in the radial direction Dr and the circumferential direction Dc. However, unlike the frame upstream-side end plate 43 in the first embodiment, the frame upstream-side end plate 43*a* gradually spreads to the axial upstream side Dau toward the radial inner side Dri. Therefore, the inner surface facing the exhaust auxiliary space 40*s* in the frame upstream-side end plate 43*a* is a surface gradually facing the axial upstream side Dau toward the radial inner side Dri. The edge on the radial outer side Dro of the frame upstream-side end plate 43*a* is connected to the edge on the axial downstream side Dad of the inner diffuser 29, that is, the portion in the inner diffuser 29 which defines the edge on the axial upstream side Dau of the opening 41.

The frame inner peripheral plate 44 defines the edge on the radial inner side Dri in the exhaust auxiliary space 40*s*. The frame inner peripheral plate 44 connects the edge on the radial inner side Dri of the frame upstream-side end plate 43*a* and the edge on the radial inner side Dri of the frame downstream-side end plate 42 to each other. As described above, the frame upstream-side end plate 43*a* gradually spreads to the axial upstream side Dau toward the radial inner side Dri. Therefore, the edge on the radial inner side Dri of the frame upstream-side end plate 43*a* is located on the axial upstream side Dau from the edge on the radial outer side Dro of the frame upstream-side end plate 43*a*.

As described above, the edge on the radial inner side Dri of the frame upstream-side end plate 43*a* in the present embodiment is located on the axial upstream side Dau from the edge on the radial outer side Dro of the frame upstream-side end plate 43*a*. Therefore, even when in the axial direction Da, the position of the edge on the axial upstream side Dau of the opening 41 in the present embodiment is the same as the position of the edge on the axial upstream side Dau of the opening 41 in the first embodiment, and even when in the axial direction Da, the position of the edge on the axial downstream side Dad of the opening 41 in the present embodiment is the same as the position of the edge on the axial downstream side Dad of the opening 41 in the first embodiment, a volume of the exhaust auxiliary space 40*s* in the present embodiment can be increased than a volume of the exhaust auxiliary space 40*s* in the first embodiment.

Next, an advantageous effect of the exhaust chamber 25*a* in the present embodiment described above will be described with reference to FIG. 8.

In the present embodiment, as in the comparative example and the first embodiment, the steam flowing out from the last stage rotor blade row 13*a* of the turbine rotor to the axial downstream side Dad flows into the diffuser space 26*s*. While the steam flows toward the axial downstream side Dad inside the diffuser space 26*s*, the steam flows toward the radial outer side Dro, and flows into the exhaust space 30*s*.

As in the comparative example and the first embodiment, in the non-exhaust side exhaust space 30*su*, the steam flowing to the radial inner side Dri, that is, the backflow of the steam is generated along the casing downstream-side end plate 32. In the present embodiment as well, as in the first embodiment, the steam enters the exhaust auxiliary space 40*s* through the non-exhaust side opening portion 41*u* of the auxiliary exhaust frame 40*a*. Therefore, in the present embodiment, the circulation region Z in which the steam flows back inside the exhaust main flow path S also decreases than that in the comparative example, and the circulation region Z can be limited within a region on the radial outer side Dro inside the exhaust main flow path S. Therefore, in the present embodiment, the pressure loss of the steam decreases than that of the comparative example, and the pressure recovery amount of the steam inside the exhaust main flow path S can be improved.

In addition, in the present embodiment, as described above, the volume of the exhaust auxiliary space 40*s* can be increased than the volume of the exhaust auxiliary space 40*s* in the first embodiment. Therefore, even when the flow rate of the steam flowing to the radial inner side Dri increases along the casing downstream-side end plate 32 inside the non-exhaust side exhaust space 30*su*, it is possible to cope with the increased flow rate. That is, in the present embodiment, even when the flow rate of the backflow of the steam increases, the steam can be introduced into the exhaust auxiliary space 40*s*.

Figure 4:
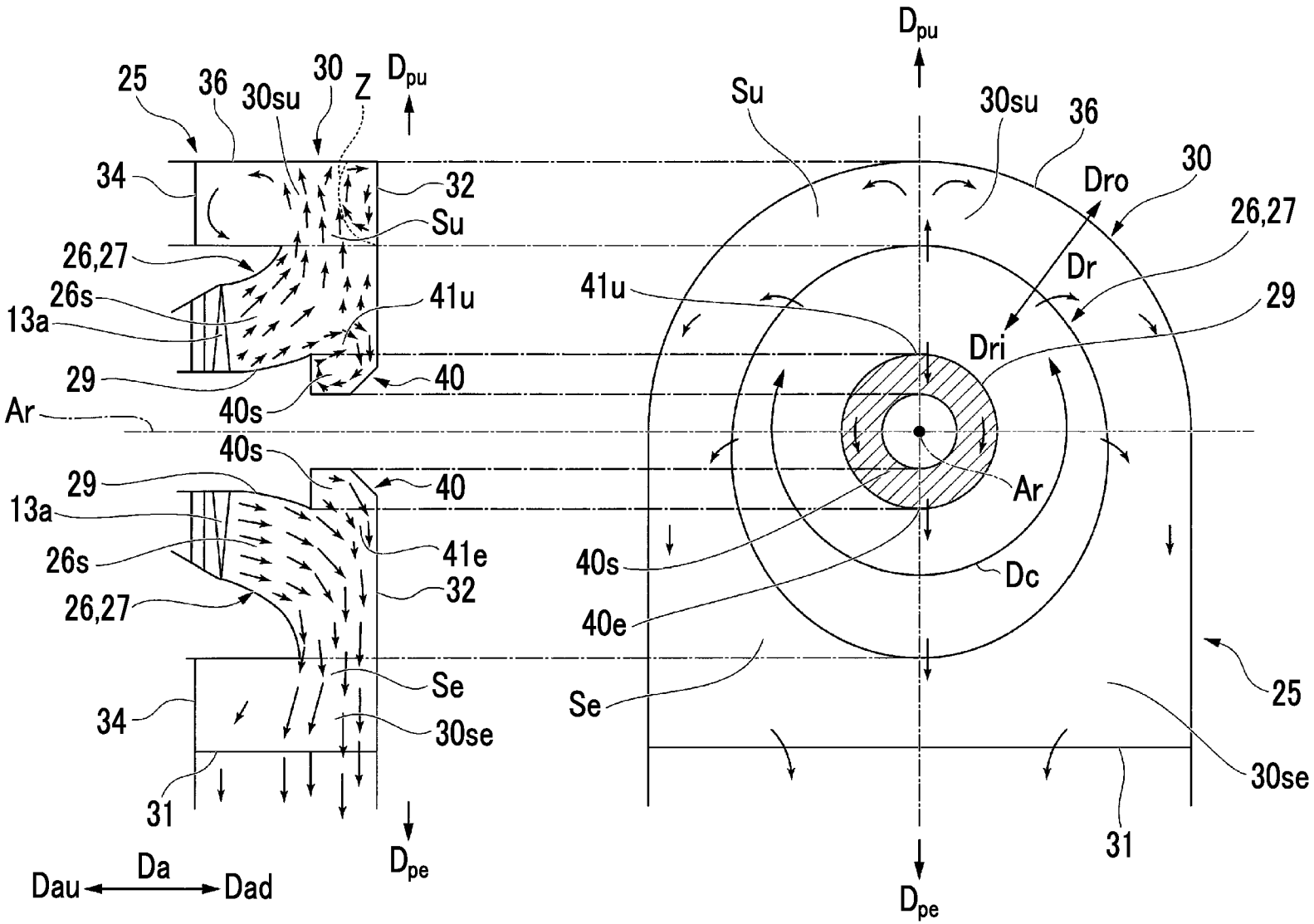
FIG. 4 is a view for describing a steam flow inside an exhaust chamber according to the first embodiment of the present invention.

Incidentally, in the first embodiment, as illustrated in FIG. 4, with regard to the directional component in the flow direction of the steam flowing into the exhaust side main flow path Se from the inside of the exhaust auxiliary space 40*s* via the exhaust side opening portion 41*e*, the directional component on the radial outer side Dro is larger than the directional component in the axial direction Da. In addition, the component in the axial direction Da in the flow direction of the steam flowing inside the exhaust side exhaust main flow path Se is larger than the component in the axial direction Da in the flow direction of the steam flowing into the exhaust side main flow path Se from the inside of the exhaust auxiliary space 40*s* via the exhaust side opening portion 41*e*. Therefore, in the first embodiment, the flow of the steam flowing into the exhaust side main flow path Se from the inside of the exhaust auxiliary space 40*s* via the exhaust side opening portion 41*e* and the steam flowing inside the exhaust side main flow path Se are mixed with each other at a large angle. Therefore, in the first embodiment, a flow turbulence of the steam flowing inside the exhaust side main flow path Se increases, and the pressure loss of the steam is slightly increased.

As described above, the frame upstream-side end plate 43*a* of the present embodiment gradually spreads to the axial upstream side Dau toward the radial inner side Dri. In other words, the frame upstream-side end plate 43*a* of the present embodiment gradually spreads to the axial downstream side Dad toward the radial outer side Dro. Therefore, in the present embodiment, the directional component on the radial outer side Dro in the flow direction of the steam flowing into the exhaust side main flow path Se from the inside of the exhaust auxiliary space 40*s* via the exhaust side opening portion 41*e* is smaller than the directional component on the radial outer side Dro in the flow direction of the steam in the first embodiment. Therefore, in the present embodiment, compared to the first embodiment, the flow turbulence of the steam flowing inside the exhaust side main flow path Se can be suppressed, and an increase in the pressure loss of the steam can be suppressed.

Third Embodiment

A third embodiment of the steam turbine according to the present invention will be described with reference to FIGS. 9 to 11.

The steam turbine in the present embodiment is different from the steam turbine in the first embodiment and the second embodiment only in a configuration of an exhaust chamber. Therefore, hereinafter, the exhaust chamber according to the present embodiment will be mainly described.

Figure 9:
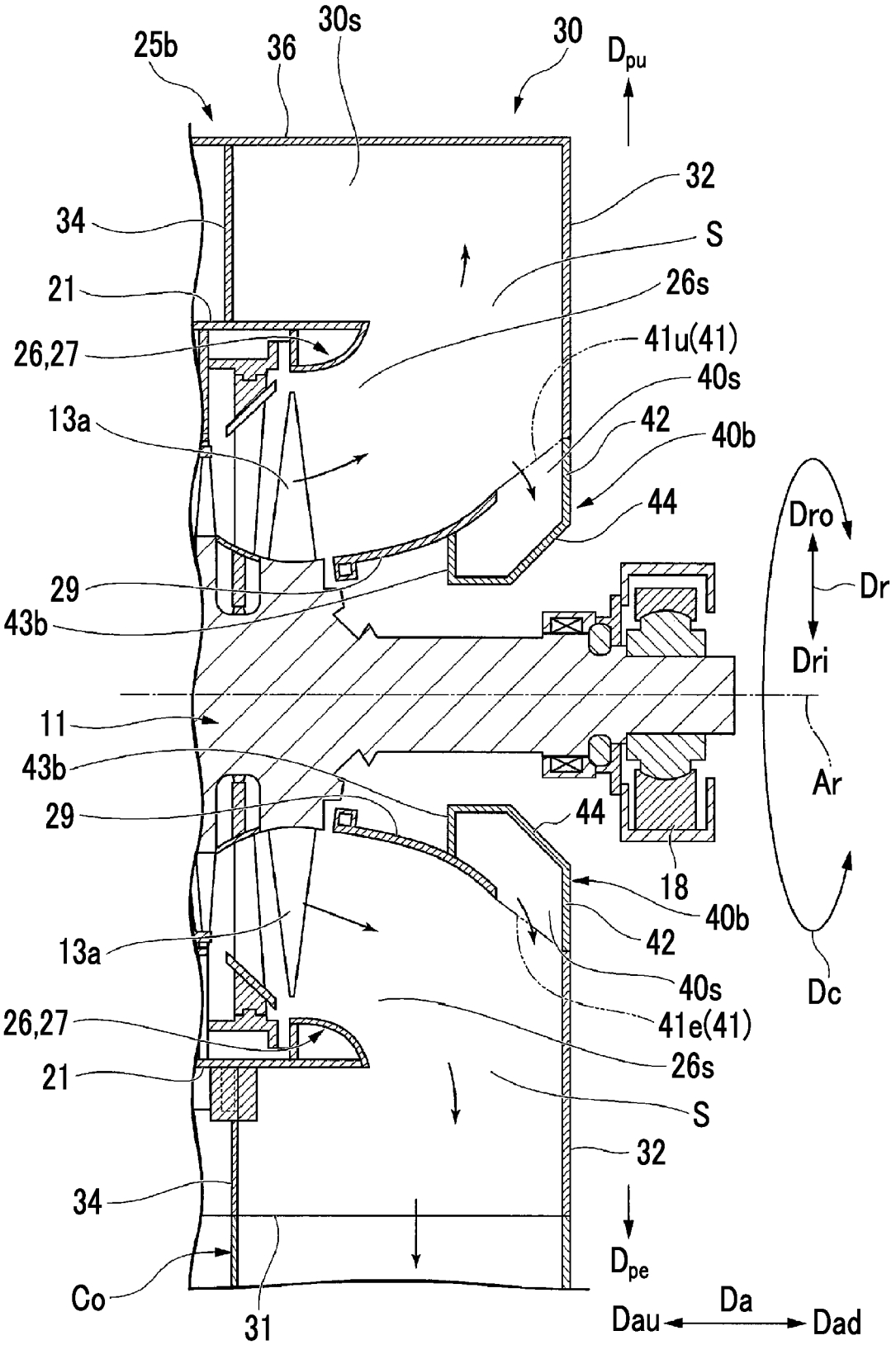
FIG. 9 is a sectional view of a main part of a steam turbine according to a third embodiment of the present invention.
Figure 10:
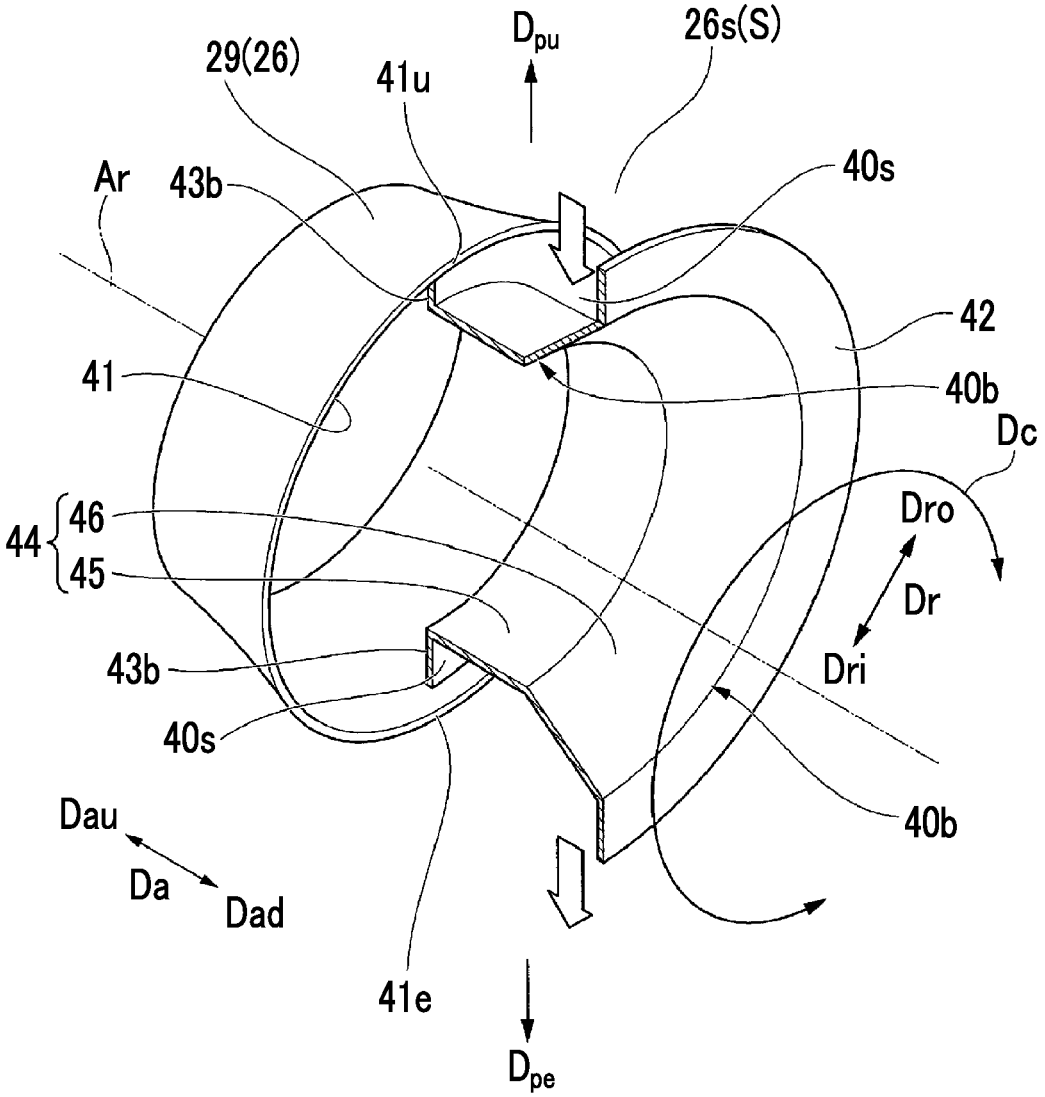
FIG. 10 is a perspective view of an inner diffuser and an auxiliary exhaust frame according to the third embodiment of the present invention.
Figure 11:
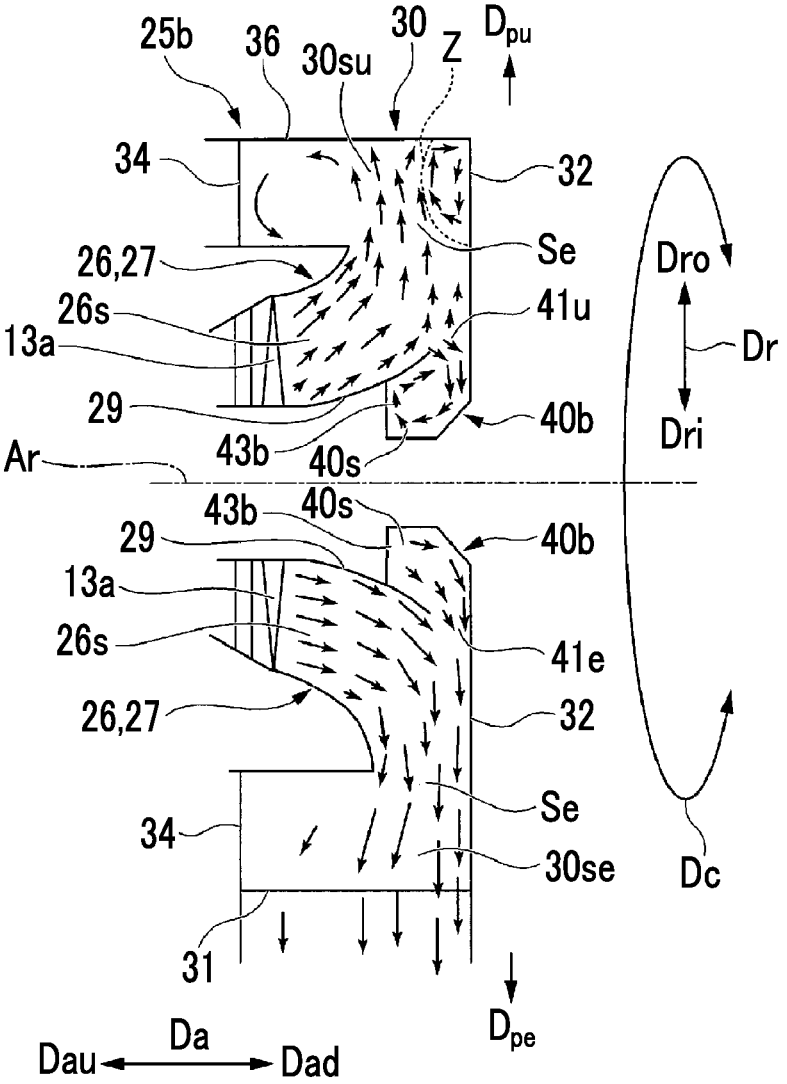
FIG. 11 is a view for describing a steam flow inside an exhaust chamber according to the third embodiment of the present invention.

As illustrated in FIGS. 9 and 10, an exhaust chamber 25*b* in the present embodiment also has the diffuser 26, the exhaust casing 30, and the auxiliary exhaust frame 40*b*, as in the exhaust chambers 25 and 25*a* in the first embodiment and the second embodiment. The diffuser 26 in the present embodiment is basically the same as the diffuser 26 in the first embodiment and the second embodiment. In addition, the exhaust casing 30 in the present embodiment is basically the same as the exhaust casing 30 in the first embodiment and the second embodiment. However, the auxiliary exhaust frame 40*b* in the present embodiment is different from the auxiliary exhaust frames 40 and 40*a* in the first embodiment and the second embodiment.

As in the auxiliary exhaust frames 40 and 40*a* in the first embodiment and the second embodiment, the auxiliary exhaust frame 40*b* in the present embodiment also includes a partial region on the radial inner side Dri from the diffuser 26, and forms the exhaust auxiliary space 40*s* having an annular shape around the axis Ar.

As in the auxiliary exhaust frame 40 in the first embodiment, the auxiliary exhaust frame 40*b* also has the opening 41 open toward the radial outer side Dro from the inside of the exhaust auxiliary space 40*s*, and through which the exhaust space 30*s* and the exhaust auxiliary space 40*s* communicate with each other. The opening 41 in the present embodiment has the annular shape around the axis Ar. An edge on the axial upstream side Dau of the opening 41 is defined by an edge on the axial downstream side Dad of the inner diffuser 29. In the opening 41, the portion facing vertically upward from the inside of the exhaust auxiliary space 40*s* is the non-exhaust side opening portion 41*u*, and the portion facing vertically downward from the inside of the exhaust auxiliary space 40*s* is the exhaust side opening portion 41*e*.

As in the auxiliary exhaust frame 40 in the first embodiment and the second embodiment, the auxiliary exhaust frame 40*b* in the present embodiment has the frame downstream-side end plate 42, the frame upstream-side end plate 43*b*, and the frame inner peripheral plate 44.

The frame downstream-side end plate 42 defines an edge on the axial downstream side Dad in the exhaust auxiliary space 40*s*. The frame downstream-side end plate 42 is the same as the frame downstream-side end plate 42 in the first embodiment and the second embodiment, and is an annular plate spreading in the direction including the component in the radial direction Dr and in the circumferential direction Dc. The edge on the radial outer side Dro of the frame downstream-side end plate 42 is connected to the edge on the radial inner side Dri of the casing downstream-side end plate 32.

The frame upstream-side end plate 43*b* defines an edge on the axial upstream side Dau in the exhaust auxiliary space 40*s*. The frame upstream-side end plate 43*b* is the same as the frame upstream-side end plate 43 in the first embodiment, and is an annular plate spreading in the radial direction Dr and the circumferential direction Dc. However, unlike the frame upstream-side end plates 43 and 43*a* in the first embodiment and the second embodiment, the edge on the radial outer side Dro of the frame upstream-side end plate 43*b* is connected to the inner diffuser 29 at a position on the axial upstream side Dau from the edge on the axial upstream side Dau of the opening 41.

As described above, the edge on the radial outer side Dro of the frame upstream-side end plate 43*b* in the present embodiment is connected to the inner diffuser 29 at the position on the axial upstream side Dau from the edge on the axial upstream side Dau of the opening 41. Therefore, even when in the axial direction Da, the position of the edge on the axial upstream side Dau of the opening 41 in the present embodiment is the same as the position of the edge on the axial upstream side Dau of the opening 41 in the first embodiment, and even when in the axial direction Da, the position of the edge on the axial downstream side Dad of the opening 41 in the present embodiment is the same as the position of the edge on the axial downstream side Dad of the opening 41 in the first embodiment, the volume of the exhaust auxiliary space 40*s* in the present embodiment can be increased than the volume of the exhaust auxiliary space 40*s* in the first embodiment and the second embodiment.

Next, an advantageous effect of the exhaust chamber 25*b* in the present embodiment described above will be described with reference to FIG. 11.

As in the comparative example, the first embodiment, and the second embodiment, in the present embodiment, the steam flowing out from the last stage rotor blade row 13*a* of the turbine rotor to the axial downstream side Dad also flows into the diffuser space 26*s*. While the steam flows toward the axial downstream side Dad inside the diffuser space 26*s*, the steam flows toward the radial outer side Dro, and flows into the exhaust space 30*s*.

As in the comparative example and the first embodiment, in the non-exhaust side exhaust space 30*su*, the steam flowing to the radial inner side Dri, that is, the backflow of the steam is generated along the casing downstream-side end plate 32. As in the first embodiment and the second embodiment, in the present embodiment, the steam also enters the inside of the exhaust auxiliary space 40*s* via the non-exhaust side opening portion 41*u* of the auxiliary exhaust frame 40*b*. Therefore, in the present embodiment, the circulation region Z in which the steam flows back inside the exhaust main flow path S also decreases than that in the comparative example, and the circulation region Z can be limited within a region on the radial outer side Dro inside the exhaust main flow path S. Therefore, in the present embodiment, the pressure loss of the steam also decreases than that of the comparative example, and the pressure recovery amount of the steam inside the exhaust main flow path S can be improved.

In addition, in the present embodiment, as described above, the volume of the exhaust auxiliary space 40*s* can be increased than the volume of the exhaust auxiliary space 40*s* in the first embodiment and the second embodiment. Therefore, even when the flow rate of the steam flowing to the radial inner side Dri increases along the casing downstream-side end plate 32 inside the non-exhaust side exhaust space 30*su*, it is possible to cope with the increased flow rate. That is, in the present embodiment, even when the flow rate of the backflow of the steam increases, the steam can be introduced into the exhaust auxiliary space 40*s*.

As described above, the edge on the radial outer side Dro of the frame upstream-side end plate 43*b* of the present embodiment is connected to the inner diffuser 29 at the position on the axial upstream side Dau from the edge on the axial upstream side Dau of the opening portions 41*u* and 41*e*. Therefore, in the present embodiment, a portion of the steam inside the exhaust auxiliary space 40*s* on the exhaust side Dpe with reference to the axis Ar flows along the inner peripheral surface of the inner diffuser 29. The inner peripheral surface of the inner diffuser 29 gradually spreads to the axial downstream side Dad toward the radial outer side Dro. Accordingly, a portion of the steam inside the exhaust auxiliary space 40*s* gradually flows to the axial downstream side Dad toward the radial outer side Dro. Therefore, in the present embodiment, the directional component on the radial outer side Dro in the flow direction of the steam flowing into the exhaust side main flow path Se from the inside of the exhaust auxiliary space 40*s* via the exhaust side opening portion 41*e* is smaller than the directional component on the radial outer side Dro in the flow direction of the steam in the first embodiment. Therefore, in the present embodiment, as in the second embodiment, compared to the first embodiment, the flow turbulence of the steam flowing inside the exhaust side main flow path Se can be suppressed, and the pressure loss of the steam can decrease.

Fourth Embodiment

A fourth embodiment of the steam turbine according to the present invention will be described with reference to FIGS. 12 and 13.

The steam turbine in the present embodiment is a modification example of the steam turbine in the third embodiment.

Figure 12:
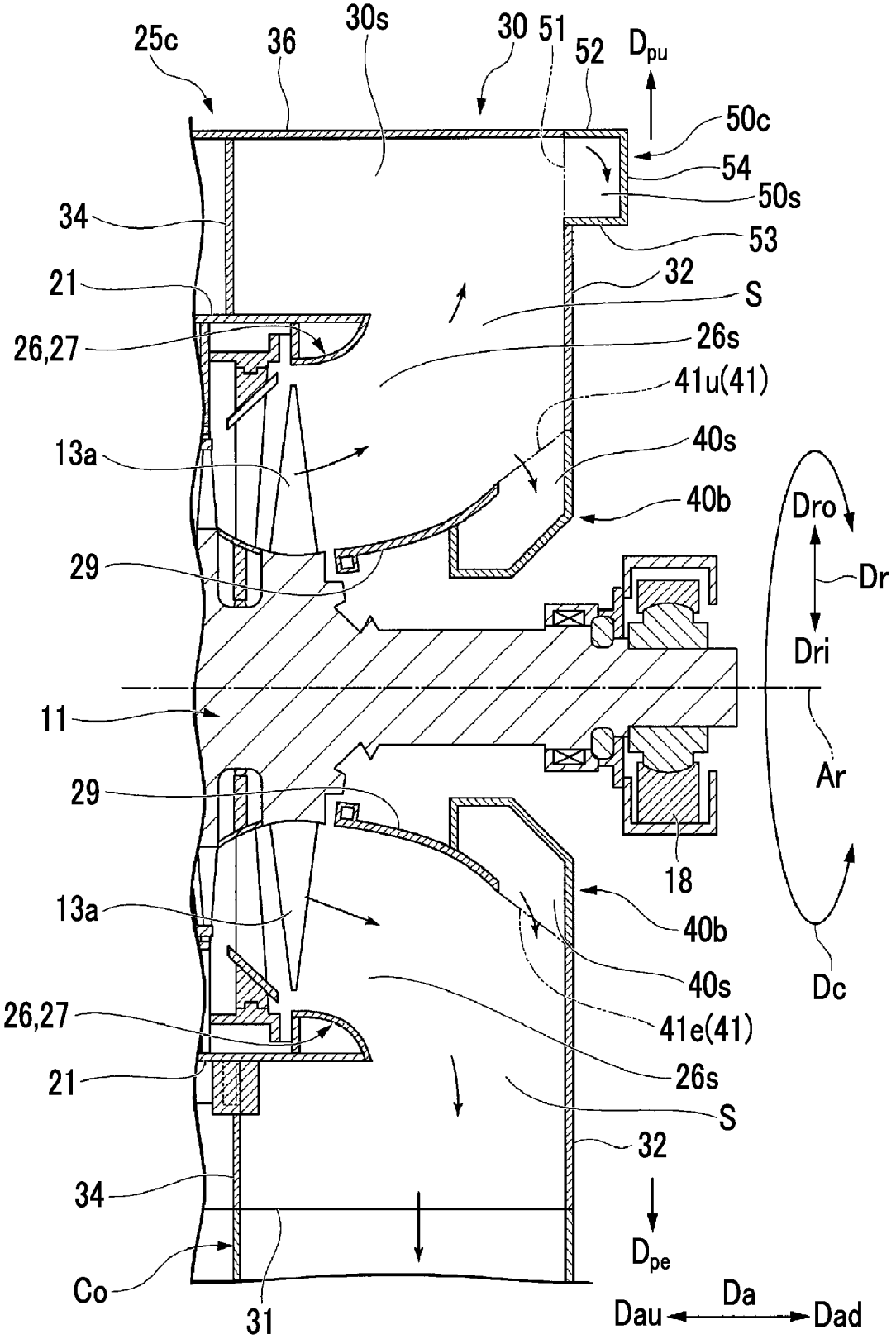
FIG. 12 is a sectional view of a main part of a steam turbine according to a fourth embodiment of the present invention.
Figure 13:
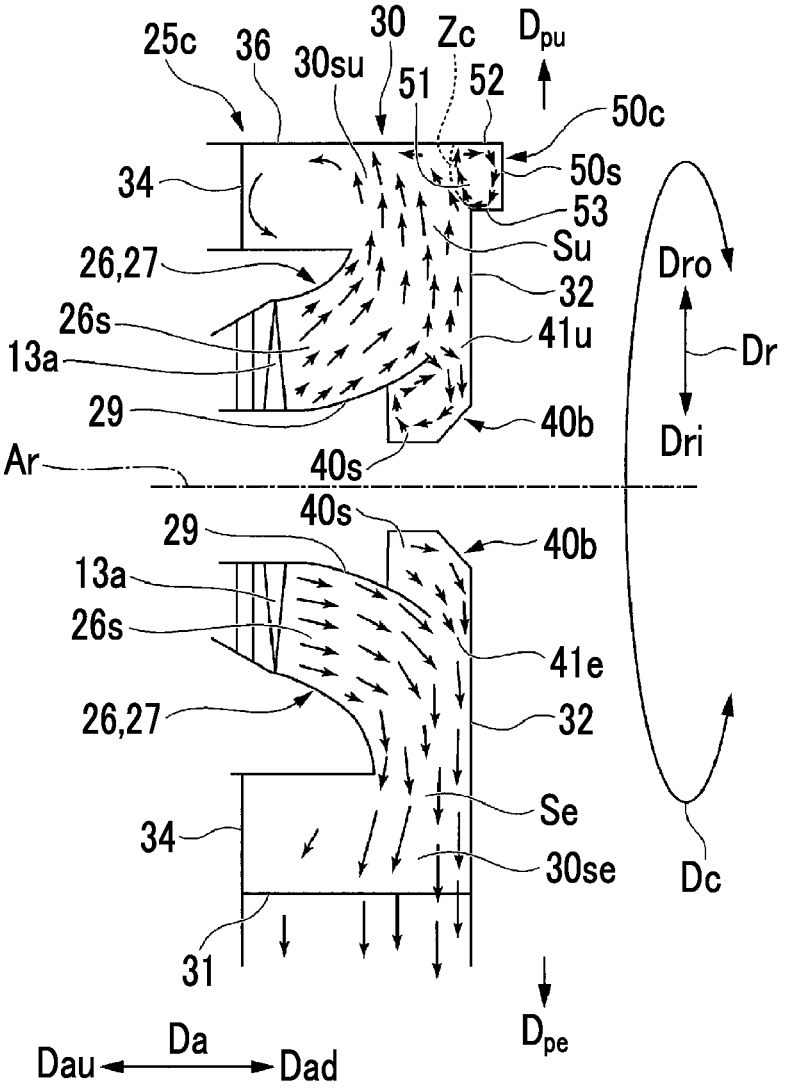
FIG. 13 is a view for describing a steam flow inside an exhaust chamber according to the fourth embodiment of the present invention.

As illustrated in FIG. 12, as in the exhaust chamber 25*b* in the third embodiment, the exhaust chamber 25*c* in the present embodiment also has the diffuser 26, the exhaust casing 30, and the auxiliary exhaust frame 40*b*. The exhaust chamber 25*c* in the present embodiment further includes a second auxiliary exhaust frame 50*c* in addition to a first auxiliary exhaust frame 40*b* which is the auxiliary exhaust frame 40*b* in the third embodiment.

The second auxiliary exhaust frame 50*c* communicates with at least a portion on the non-exhaust side Dpu in the exhaust space 30*s*, and forms a second exhaust auxiliary space 50*s* different from the first exhaust auxiliary space 40*s* which is the exhaust auxiliary space 40*s* described above. The second exhaust auxiliary space 50*s* is a space spreading in the circumferential direction Dc along the casing outer peripheral plate 36 on the axial downstream side Dad from the casing downstream-side end plate 32, at least in a region on the non-exhaust side Dpu with reference to the axis Ar.

The second auxiliary exhaust frame 50*c* has a second frame outer peripheral plate 52, a second frame inner peripheral plate 53, and a second frame downstream-side end plate 54. The second frame outer peripheral plate 52 extends from the edge on the axial downstream side Dad of the casing outer peripheral plate 36 to the axial downstream side Dad and, spreads in the circumferential direction Dc, at least in a region on the non-exhaust side Dpu with reference to the axis Ar. The second frame inner peripheral plate 53 extends from the edge on the radial outer side Dro of the casing downstream-side end plate 32 to the axial downstream side Dad, and spreads in the circumferential direction Dc, at the position on the radial inner side Dri from the casing outer peripheral plate 36 and the second frame outer peripheral plate 52, at least in the region on the non-exhaust side Dpu with reference to the axis Ar. The second frame downstream-side end plate 54 is a plate spreading in the radial direction Dr and the circumferential direction Dc, at least in the region on the non-exhaust side Dpu with reference to the axis Ar. The edge on the radial outer side Dro on a second frame downstream-side end plate 54 is connected to the edge on the axial downstream side Dad of the second frame outer peripheral plate 52. In addition, the edge on the radial inner side Dri of the second frame downstream-side end plate 54 is connected to the edge on the axial downstream side Dad of the second frame inner peripheral plate 53.

The edge on the axial upstream side Dau of the second frame outer peripheral plate 52 defines the edge on the radial outer side Dro of the second opening 51 serving as the opening through which the exhaust space 30*s* and the second exhaust auxiliary space 50*s* communicate with each other. In addition, the edge on the axial upstream side Dau of the second frame inner peripheral plate 53 defines the edge on the radial inner side Dri of the second opening 51.

Next, an advantageous effect of the exhaust chamber 25*c* in the present embodiment described above will be described with reference to FIG. 13.

The exhaust chamber 25*c* in the present embodiment has the first auxiliary exhaust frame 40*b* the same as the exhaust chamber 25*b* in the third embodiment. Accordingly, as in the third embodiment, a circulation region Zc inside a non-exhaust side exhaust main flow path Su can be reduced, compared to the comparative example, and the circulation region Zc can be limited within a region on the radial outer side Dro inside the exhaust main flow path S.

In the present embodiment, the region on the radial outer side Dro inside the exhaust main flow path S communicates with the second exhaust auxiliary space 50*s*. Therefore, a portion of the steam inside the region on the radial outer side Dro inside the exhaust main flow path S flows into the second exhaust auxiliary space 50*s*. As a result, the circulation region Zc inside the exhaust main flow path S further decreases due to the presence of the second exhaust auxiliary space 50*s*. A portion of the steam flowing into the second exhaust auxiliary space 50*s* circulates inside the second exhaust auxiliary space 50*s*, and thereafter, immediately returns to the exhaust main flow path S. In addition, the remaining portion of the steam flowing into the second exhaust auxiliary space 50*s* returns to the inside of the exhaust main flow path S from an end in the circumferential direction Dc of the second exhaust auxiliary space 50*s* spreading in the circumferential direction Dc.

As described above, in the present embodiment, the circulation region Zc in the exhaust main flow path S can be reduced, compared to the third embodiment.

Fifth Embodiment

A fifth embodiment of the steam turbine according to the present invention will be described with reference to FIGS. 14 and 15.

The steam turbine in the present embodiment is a modification example of the steam turbine in the third embodiment.

Figure 14:
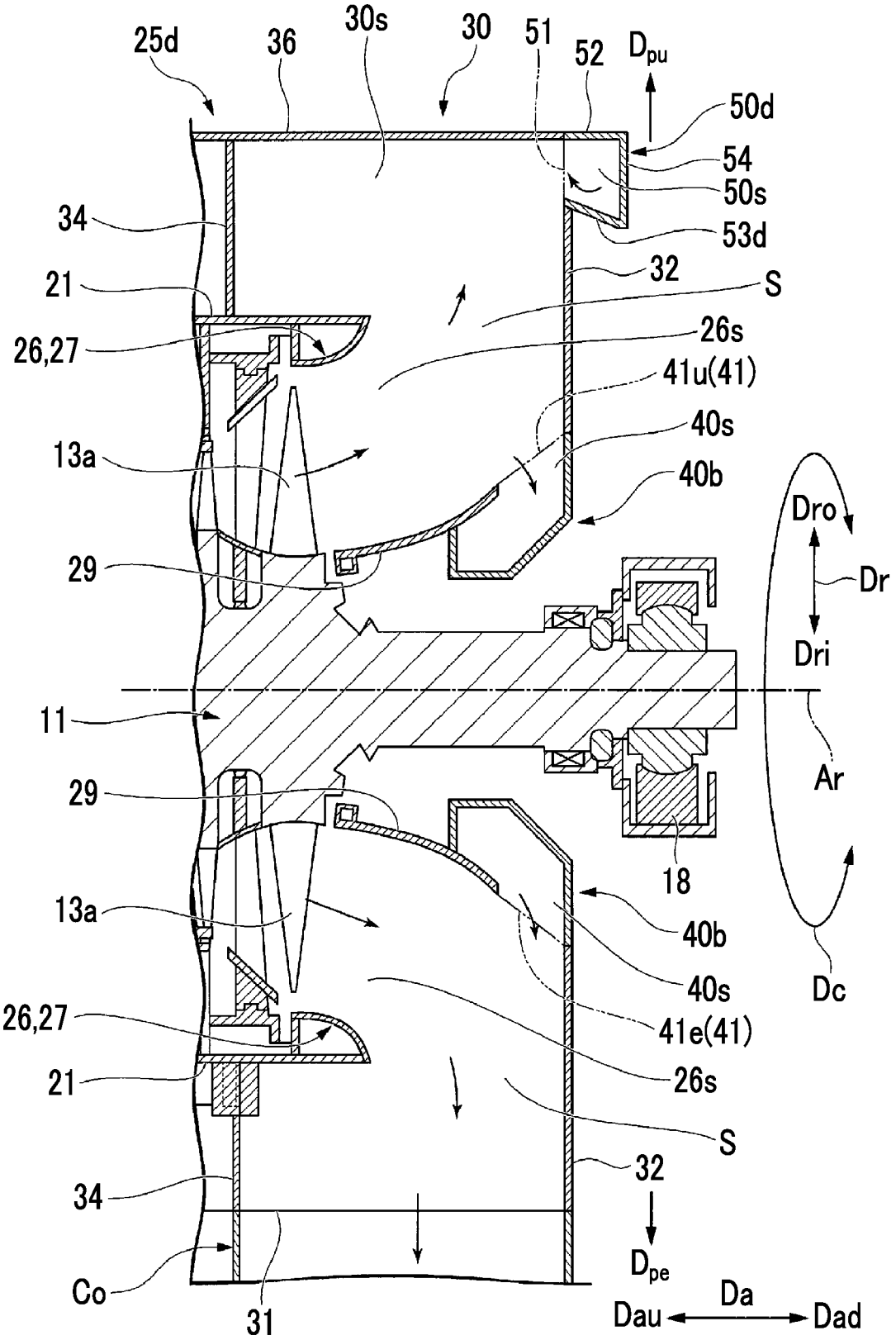
FIG. 14 is a sectional view of a main part of a steam turbine according to a fifth embodiment of the present invention.
Figure 15:
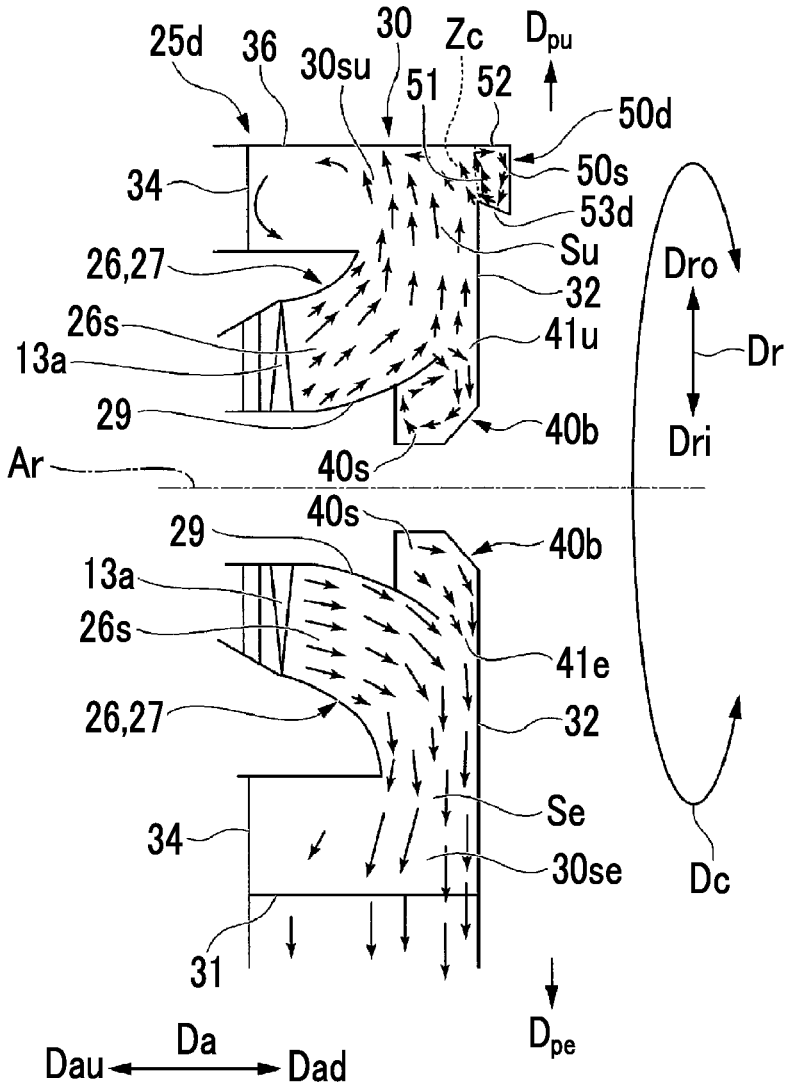
FIG. 15 is a view for describing a steam flow inside an exhaust chamber according to the fifth embodiment of the present invention.

As illustrated in FIG. 14, as in the exhaust chambers 25*b* and 25*c* in the third embodiment and the fourth embodiment, an exhaust chamber 25*d* in the present embodiment also has the diffuser 26, the exhaust casing 30, and the first auxiliary exhaust frame 40*b*. The exhaust chamber 25*d* in the present embodiment further includes a second auxiliary exhaust frame 50*d*, as in the exhaust chamber 25*c* in the fourth embodiment.

As in the second auxiliary exhaust frame 50*c* in the fourth embodiment, the second auxiliary exhaust frame 50*d* communicates with at least a portion on the non-exhaust side Dpu in the exhaust space 30*s*, and forms a second exhaust auxiliary space 50*s* different from the first exhaust auxiliary space 40*s*. The second exhaust auxiliary space 50*s* is a space spreading in the circumferential direction Dc along the casing outer peripheral plate 36 on the axial downstream side Dad from the casing downstream-side end plate 32, at least in a region on the non-exhaust side Dpu with reference to the axis Ar.

As in the second auxiliary exhaust frame 50*c* in the fourth embodiment, the second auxiliary exhaust frame 50*d* has the second frame outer peripheral plate 52, the second frame inner peripheral plate 53*d*, and the second frame downstream-side end plate 54.

As in the second frame outer peripheral plate 52 in the fourth embodiment, the second frame outer peripheral plate 52 extends to the axial downstream side Dad from the edge on the axial downstream side Dad of the casing outer peripheral plate 36, and spreads in the circumferential direction Dc, at least in the region on the non-exhaust side Dpu with reference to the axis Ar.

As in the second frame inner peripheral plate 53 in the fourth embodiment, the second frame inner peripheral plate 53*d* extends to the axial downstream side Dad from the edge on the radial outer side Dro of the casing downstream-side end plate 32, and spreads in the circumferential direction Dc, at the position on the radial inner side Dri from the casing outer peripheral plate 36 and the second frame outer peripheral plate 52, at least in the region on the non-exhaust side Dpu with reference to the axis Ar. However, unlike the second frame inner peripheral plate 53 of the fourth embodiment, the second frame inner peripheral plate 53*d* gradually extends to the radial inner side Dri toward the axial downstream side Dad from the edge on the radial outer side Dro of the casing downstream-side end plate 32. In other words, the second frame inner peripheral plate 53*d* gradually extends to the radial outer side Dro toward the axial upstream side Dau.

As in the second frame downstream-side end plate 54 in the fourth embodiment, the second frame downstream-side end plate 54 is a plate spreading in the radial direction Dr and the circumferential direction Dc, at least in the region on the non-exhaust side Dpu with reference to the axis Ar. The edge on the radial outer side Dro on the second frame downstream-side end plate 54 is connected to the edge on the axial downstream side Dad of the second frame outer peripheral plate 52. In addition, the edge on the radial inner side Dri of the second frame downstream-side end plate 54 is connected to the edge on the axial downstream side Dad of the second frame inner peripheral plate 53*d*.

The edge on the axial upstream side Dau of the second frame outer peripheral plate 52 defines the edge on the radial outer side Dro of the second opening 51 serving as the opening through which the exhaust space 30*s* and the second exhaust auxiliary space 50*s* communicate with each other. In addition, the edge on the axial upstream side Dau of the second frame inner peripheral plate 53 defines the edge on the radial inner side Dri of the second opening 51.

Next, an advantageous effect of the exhaust chamber 25*d* in the present embodiment described above will be described with reference to FIG. 15.

The exhaust chamber 25*d* in the present embodiment has the first auxiliary exhaust frame 40*b* the same as the exhaust chambers 25*b* and 25*c* in the third embodiment and the fourth embodiment. Accordingly, as in the third embodiment and the fourth embodiment, compared to the comparative example, the circulation region Zc inside the non-exhaust side exhaust main flow path Su can be reduced, and the circulation region Zc can be limited within the region on the radial outer side Dro inside the exhaust main flow path S.

In the present embodiment, as in the fourth embodiment, the region on the radial outer side Dro in the exhaust main flow path S communicates with the second exhaust auxiliary space 50*s*. Therefore, a portion of the steam in the region on the radial outer side Dro inside the exhaust main flow path S flows into the second exhaust auxiliary space 50*s*. As a result, the circulation region Zc inside the exhaust main flow path S further decreases due to the presence of the second exhaust auxiliary space 50*s*. A portion of the steam flowing into the second exhaust auxiliary space 50*s* circulates inside the second exhaust auxiliary space 50*s*, and thereafter, immediately returns to the inside of the exhaust main flow path S. In addition, the remaining portion of the steam flowing into the second exhaust auxiliary space 50*s* returns to the inside of the exhaust main flow path S from an end in the circumferential direction Dc of the second exhaust auxiliary space 50*s* spreading in the circumferential direction Dc.

The second frame inner peripheral plate 53*d* of the second auxiliary exhaust frame 50*d* in the fifth embodiment gradually extends to the radial outer side Dro toward the axial upstream side Dau. Therefore, the steam flowing into the second exhaust auxiliary space 50*s* is more likely to circulate inside the second exhaust auxiliary space 50*s*, compared to the fourth embodiment. In the steam flowing into the second exhaust auxiliary space 50*s*, the amount of the steam returning into the exhaust main flow path S immediately decreases. Conversely, the amount of the steam returning into the exhaust main flow path S from the end in the circumferential direction Dc of the second exhaust auxiliary space 50*s* spreading in the circumferential direction Dc increases. That is, the second auxiliary exhaust frame 50*d* in the present embodiment has a structure in which the steam flowing into the second exhaust auxiliary space 50*s* positively returns into the exhaust main flow path S from the end in the circumferential direction Dc of the second exhaust auxiliary space 50*s* spreading in the circumferential direction Dc. Therefore, in the present embodiment, the circulation region Zc inside the exhaust main flow path S can be further reduced than that in the fourth embodiment.

Sixth Embodiment

A sixth embodiment of the steam turbine according to the present invention will be described with reference to FIGS. 16 and 17.

The steam turbine in the present embodiment is a modification example of the steam turbine in the third embodiment.

Figure 16:
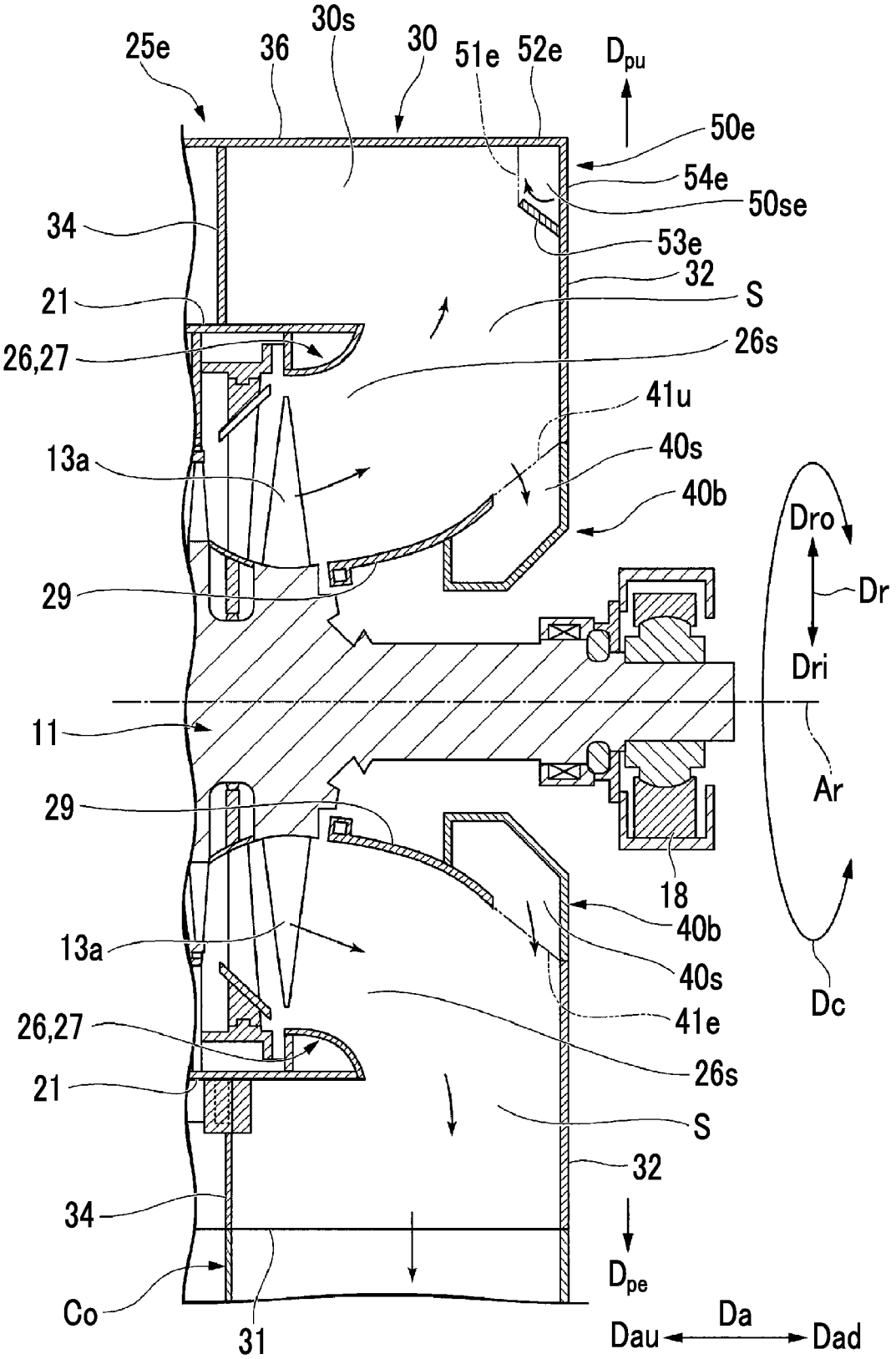
FIG. 16 is a sectional view of a main part of a steam turbine according to a sixth embodiment of the present invention.
Figure 17:
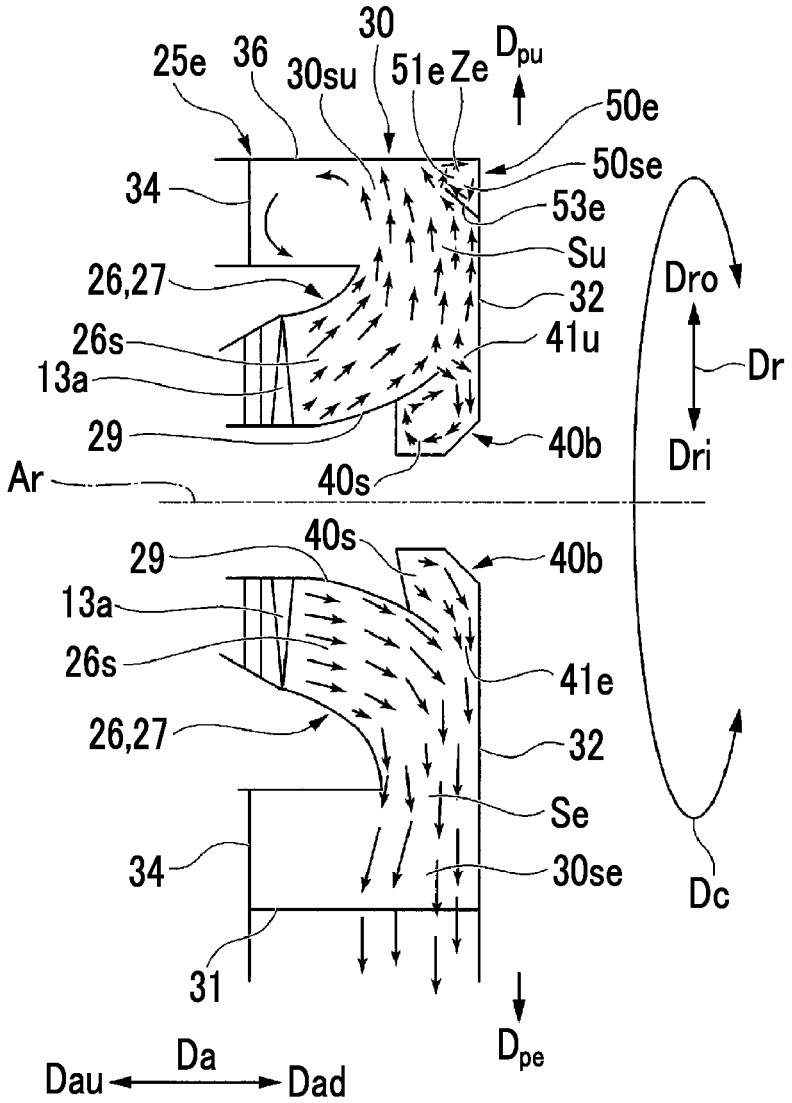
FIG. 17 is a view for describing a steam flow inside an exhaust chamber according to the sixth embodiment of the present invention.

As illustrated in FIG. 16, an exhaust chamber 25*e* in the present embodiment also has the diffuser 26, the exhaust casing 30, and the first auxiliary exhaust frame 40*b*, as in the exhaust chambers 25*b*, 25*c*, and 25*d* in the third to fifth embodiments. The exhaust chamber 25*e* in the present embodiment further includes a second auxiliary exhaust frame 50*e*, as in the exhaust chambers 25*c* and 25*d* in the fourth embodiment and the fifth embodiment.

The second auxiliary exhaust frame 50*e* communicates with at least a portion on the non-exhaust side Dpu in the exhaust space 30*s*, and forms a second exhaust auxiliary space 50*se* different from the first exhaust auxiliary space 40*s*. The second exhaust auxiliary space 50*se* is a space spreading in the circumferential direction Dc along the casing outer peripheral plate 36 on the non-exhaust side Dpu from the casing downstream-side end plate 32, at least in the region on the axial upstream side Dau with reference to the axis Ar. Therefore, unlike the second exhaust auxiliary space 50*s* in the fourth embodiment and the fifth embodiment, the second exhaust auxiliary space 50*se* in the present embodiment is formed inside the exhaust casing 30.

The second auxiliary exhaust frame 50*e* has a second frame outer peripheral plate 52*e*, a second frame inner peripheral plate 53*e*, and a second frame downstream-side end plate 54*e*. The second frame outer peripheral plate 52*e* is formed in a portion on the axial downstream side Dad of the casing outer peripheral plate 36, at least in a region on the non-exhaust side Dpu with reference to the axis Ar. The second frame downstream-side end plate 54*e* is formed in a portion on the radial outer side Dro of the casing downstream-side end plate 32, at least in the region on the non-exhaust side Dpu with reference to the axis Ar. The second frame inner peripheral plate 53*e* is a plate gradually extending to the radial outer side Dro toward the axial upstream side Dau from the casing downstream-side end plate 32, and spreading in the circumferential direction Dc toward the direction of Dc, at the position on the radial inner side Dri from the casing outer peripheral plate 36, at least in the region on the non-exhaust side Dpu with reference to the axis Ar.

The edge on the axial upstream side Dau of the second frame outer peripheral plate 52*e* defines the edge on the radial outer side Dro of the second opening 51*e* serving as the opening through which the exhaust space 30*s* and the second exhaust auxiliary space 50*s* communicate with each other. In addition, the edge on the axial upstream side Dau of the second frame inner peripheral plate 53*e* defines the edge on the radial inner side Dri of the second opening 51*e*.

Next, an advantageous effect of the exhaust chamber 25*e* in the present embodiment described above will be described with reference to FIG. 17.

The exhaust chamber 25*e* in the present embodiment has the first auxiliary exhaust frame 40*b* the same as the exhaust chambers 25*b*, 25*c*, and 25*d* in the third to fifth embodiments. Accordingly, as in the third to fifth embodiments, a circulation region Ze inside the non-exhaust side exhaust main flow path Su can be reduced, compared to that in the comparative example, and the circulation region Ze can be limited within the region on the radial outer side Dro inside the exhaust main flow path S.

In the present embodiment, the region on the radial outer side Dro inside the exhaust main flow path S communicates with the second exhaust auxiliary space 50*se*. Therefore, a portion of the steam in the region on the radial outer side Dro inside the exhaust main flow path S flows into the second exhaust auxiliary space 50*se*. A portion of the steam flowing into the second exhaust auxiliary space 50*se* circulates inside the second exhaust auxiliary space 50*se*, and thereafter, immediately returns into the exhaust main flow path S. In addition, the remaining portion of the steam flowing into the second exhaust auxiliary space 50*se* returns into the exhaust main flow path S from the end in the circumferential direction Dc of the second exhaust auxiliary space 50*se* spreading in the circumferential direction Dc.

As in the second frame inner peripheral plate 53*d* in the fifth embodiment, the second frame inner peripheral plate 53*e* in the sixth embodiment gradually extends to the radial outer side Dro toward the axial upstream side Dau. Therefore, the steam flowing into the second exhaust auxiliary space 50*se* is more likely to circulate inside the second exhaust auxiliary space 50*se*, compared to the fourth embodiment. Therefore, in the steam flowing into the second exhaust auxiliary space 50*se*, the amount of the steam returning into the exhaust main flow path S immediately decreases. Conversely, the amount of the steam returning into the exhaust main flow path S from the end in the circumferential direction Dc of the second exhaust auxiliary space 50*se* spreading in the circumferential direction Dc increases. That is, as in the fifth embodiment, the second auxiliary exhaust frame 50*e* in the present embodiment also has a structure in which the steam flowing into the second exhaust auxiliary space 50*se* positively returns into the exhaust main flow path S from the end in the circumferential direction Dc of the second exhaust auxiliary space 50*se* spreading in the circumferential direction Dc. Therefore, as described above, although the second exhaust auxiliary space 50*se* in the present embodiment is formed inside the exhaust casing 30, the circulation region Ze inside the exhaust casing 30 can be further reduced than that in the third embodiment.

Various Modification Example

The second frame downstream-side end plates 54 and 54*e* in the fourth to sixth embodiments extend in the radial direction Dr. However, the second frame downstream-side end plates 54 and 54*e* may be portions on the radial outer side Dro, and may gradually extend to the axial upstream side Dau toward the radial outer side Dro. In addition, the second frame downstream-side end plates 54 and 54*e* may be portions on the radial inner side Dri, and may gradually extend to the axial downstream side Dad as the second frame downstream-side end plates 54 and 54*e* extend to the radial outer side Dro.

The casing downstream-side end plate 32 in each of the above-described embodiments extends in the radial direction Dr. However, the casing downstream-side end plate 32 may be a portion on the radial outer side Dro, and may gradually extend to the axial upstream side Dau as the casing downstream-side end plate 32 extends to the radial outer side Dro. In addition, the casing downstream-side end plate 32 may be a portion on the radial inner side Dri, and may gradually extend to the axial downstream side Dad as the casing downstream-side end plate 32 extends to the radial outer side Dro.

The steam turbines in the fourth to sixth embodiments are modification examples of the steam turbine in the third embodiment. However, the configurations of the second auxiliary exhaust frames 50*c*, 50*d*, and 50*e* in the fourth to sixth embodiments may be applied to the steam turbine in the first embodiment or the second embodiment.

The second exhaust auxiliary spaces 50*s* and 50*se* in the fourth to sixth embodiments are spaces spreading in the circumferential direction Dc, in the region on the non-exhaust side Dpu with reference to the axis Ar. However, the second exhaust auxiliary spaces 50*s* and 50*se* may be annular spaces formed around the axis Ar.

Figure 18:
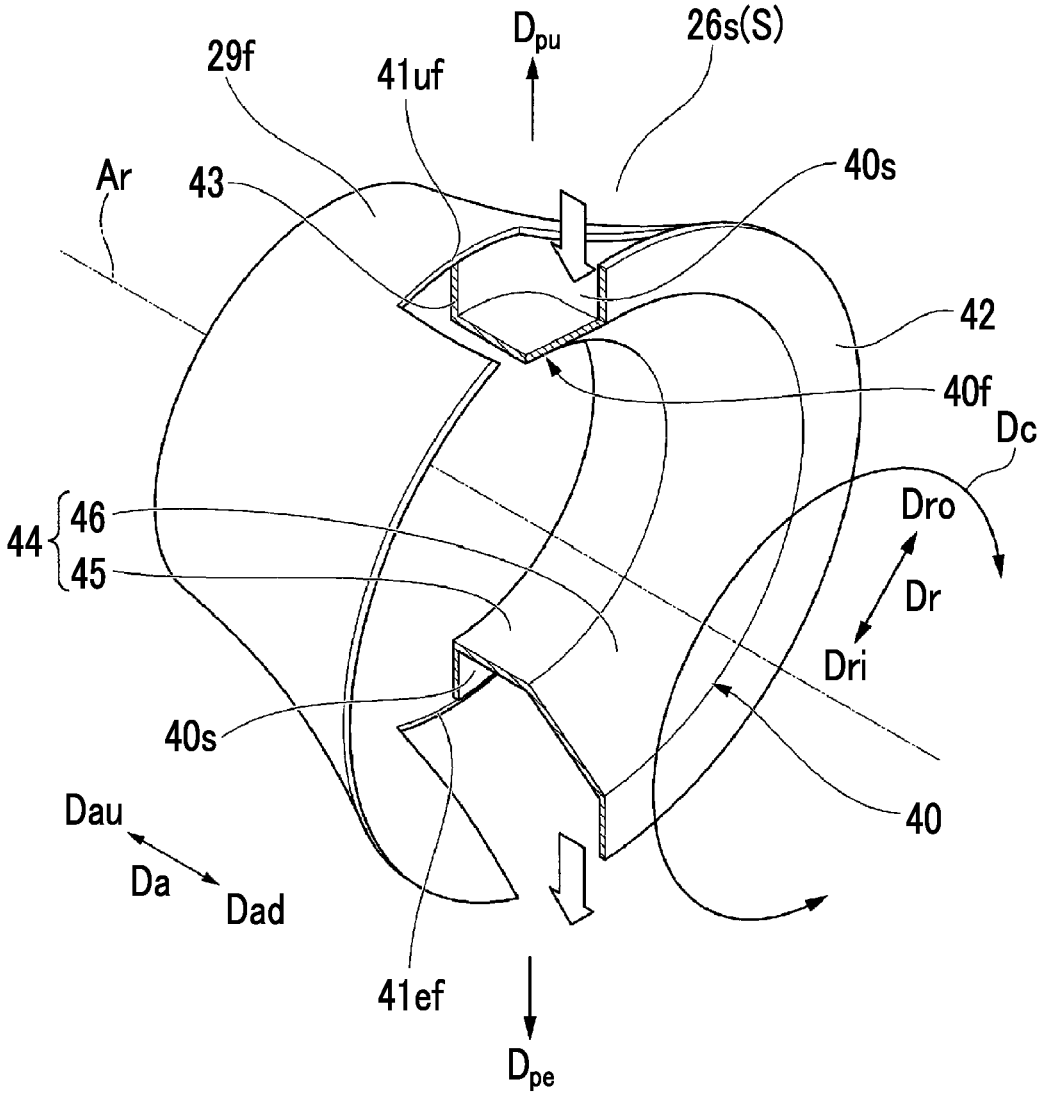
FIG. 18 is a perspective view of an inner diffuser and an auxiliary exhaust frame in a modification example of the first embodiment according to the present invention.

All of the openings 41 of the auxiliary exhaust frames (first auxiliary exhaust frame) in the above-described respective embodiments have an annular shape formed around the axis Ar. The edge on the axial upstream side Dau of the opening 41 is an entire peripheral edge on the axial downstream side Dad of the inner diffuser 29. Therefore, the entire peripheral edge on the axial downstream side Dad of the inner diffuser 29 is separated from the casing downstream-side end plate 32 in the axial direction Da. As illustrated in FIG. 18, an auxiliary exhaust frame (first auxiliary exhaust frame) 40*f* may have a non-exhaust side opening portion 41*uf* and an exhaust side opening portion 41*ef* which are vertically open upward from the inside of the exhaust auxiliary space 40*s*. In this case, a portion of the edge on the axial downstream side Dad of the inner diffuser 29*f* defines the edge on the axial upstream side Dau of the non-exhaust side opening portion 41*uf*, the other portion defines the edge on the axial upstream side Dau of the exhaust side opening portion 41*ef*, and the remaining portion is connected to the casing downstream-side end plate 32 or the frame downstream-side end plate 42. That is, the respective openings 41*uf* and 41*ef* in this case are formed by cutting out a portion of the inner diffuser 29*f*. Although FIG. 18 illustrates a modification example of the first embodiment, the openings 41 in the second to sixth embodiments may be formed in the same manner as described above.

As described above, independent openings are formed on the non-exhaust side Dpu and the exhaust side Dpe. Even in this case, it is possible to reduce a decrease in efficiency in the portion on the non-exhaust side Dpu inside the exhaust chamber. However, as in each of the above-described embodiments, in a case of an annular opening, the steam flows from the non-exhaust side Dpu to the exhaust side Dpe in a space where the exhaust auxiliary space 40*s* and the exhaust space 30*s* are integrated with each other. Accordingly, it is not necessary to consider a loss in a branching portion or a merging portion of the opening. On the other hand, when the independent openings are formed on the non-exhaust side Dpu and the exhaust side Dpe, the flow may be disturbed near an inlet or an outlet of each opening, thereby causing a possibility of a pressure loss. Therefore, when the independent openings are formed on the non-exhaust side Dpu and the exhaust side Dpe, it is necessary to carefully examine the length of the opening in the circumferential direction of each opening.

The steam turbine in the above-described respective embodiments is a downward exhaust type. However, the steam turbine may be a laterally exhaust type. In this case, in the non-exhaust side Dpu and the exhaust side Dpe which form mutually opposite sides with respect to the axis Ar in an orthogonal direction orthogonal to the axis Ar, for example, the non-exhaust side Dpu is the left side with reference to the axis Ar, and the exhaust side Dpe is the right side with reference to the axis Ar.

All of the exhaust casings 30 in the above-described respective embodiments have the casing upstream-side end plate 34. However, in a case of a two-way exhaust type, the exhaust space 30*s* of the first steam turbine unit 10*a* and the exhaust space 30*s* of the second steam turbine unit 10*b* are caused to communicate with each other in the region on the non-exhaust side Dpu with reference to the axis Ar. In this manner, the upstream-side end plate can be omitted.

All of the steam turbines of the above-described respective embodiments are the two-way exhaust types. However, the present invention may be applied to a steam turbine in which the exhaust is not branched.

INDUSTRIAL APPLICABILITY

In the exhaust chamber according to an aspect of the present invention, the pressure recovery amount can be increased by reducing the pressure loss of the steam.

REFERENCE SIGNS LIST

10*a*: first steam turbine unit
10*b*: second steam turbine unit
11 turbine rotor
12: rotor shaft
13: rotor blade row
13*a*: last stage rotor blade row
17: stator blade row
18: bearing
19: steam inlet duct
20: casing
21: cylinder casing
25, 25*a*, 25*b*, 25*c*, 25*d*, 25*e*, 25*x*: exhaust chamber
26: diffuser
26*s*: diffuser space
27: outer diffuser
29, 29*f*: inner diffuser
30,30*x*: exhaust casing
30*s*: exhaust space
30*se*: exhaust side exhaust space
30*su*: non-exhaust side exhaust space
31: exhaust port
32: casing downstream-side end plate
34: casing upstream-side end plate
36: casing outer peripheral plate
40, 40*a*, 40*b*, 40*c*: auxiliary exhaust frame (first auxiliary exhaust frame)
40*s*: exhaust auxiliary space (first exhaust auxiliary space)

41: opening
41*u*: non-exhaust side opening portion
41*uf*: non-exhaust side opening
41*e*: exhaust side opening portion
41*ef*: exhaust side opening
42: frame downstream-side end plate
43, 43*a*, 43*b*: frame upstream-side end plate
44: frame inner peripheral plate
45: upstream-side inner peripheral plate
46: downstream-side inner peripheral plate
50*c*, 50*d*, 50*e*: second auxiliary exhaust frame
50*s*, 50*se*: second exhaust auxiliary space
51, 51*e*: second opening
52, 52*e*: second frame outer peripheral plate
53, 53*d*, 53*e*: second frame inner peripheral plate
54, 54*e*: second frame downstream-side end plate
Co: condenser
S: exhaust main flow path
Se: exhaust side main flow path
Su: non-exhaust side main flow path
Z, Zc, Ze: circulation region
Ar: axis
Da: axial direction
Dau: axial upstream side
Dad: axial downstream side
Dc: circumferential direction
Dr: radial direction
Dri: radial inner side
Dro: radial outer side
Dpu: non-exhaust side
Dpe: exhaust side

The invention claimed is:

1. An exhaust chamber of a steam turbine which guides steam flowing out from a last stage rotor blade row of a steam turbine rotor rotating around an axis to an outside, comprising:

a diffuser into which the steam flowing out from the last stage rotor blade row flows, having an annular shape with respect to the axis, and forming a diffuser space that gradually spreads to a radial outer side with respect to the axis toward an axial downstream side;

an exhaust casing having an exhaust port open toward the radial outer side, communicating with the diffuser space, spreading in a circumferential direction with respect to the axis, and forming an exhaust space that guides the steam flowing from the diffuser space to the exhaust port; and an auxiliary exhaust frame including a partial region on a radial inner side from the diffuser with respect to the axis, and forming an exhaust auxiliary space having an annular shape around the axis, wherein the diffuser has an outer diffuser having an annular cross section perpendicular to the axis, gradually spreading to the radial outer side toward the axial downstream side, and defining an edge on the radial outer side of the diffuser space, and an inner diffuser having an annular cross section perpendicular to the axis, gradually spreading to the radial outer side toward the axial downstream side, and defining an edge on the radial inner side of the diffuser space with respect to the axis, the exhaust casing has an exhaust port only on an exhaust side, out of a non-exhaust side and the exhaust side which are sides to opposite to each other with reference to the axis in an orthogonal direction orthogonal to the axis, the auxiliary exhaust frame has an opening open toward the radial outer side from an inside of the exhaust auxiliary space, in at least a portion on the non-exhaust side and the exhaust side with reference to the axis, and through which the exhaust space and the exhaust auxiliary space communicate with each other, and inside a circumferential region where the opening is present in the circumferential direction, an edge on the axial downstream side of the inner diffuser defines an edge on the axial upstream side opposite to the axial downstream side in the opening.

2. The exhaust chamber of a steam turbine according to claim 1, wherein the auxiliary exhaust frame has a frame downstream-side end plate that defines an edge on the axial downstream side in the exhaust auxiliary space, the exhaust casing has a casing downstream-side end plate that defines an edge on the axial downstream side in the exhaust space, the frame downstream-side end plate spreads in a direction including a radial component with respect to the axis and in the circumferential direction, and has an annular shape around the axis, the casing downstream-side end plate spreads in the direction including the radial component with respect to the axis and in the circumferential direction, and having an edge on the radial inner side having an annular shape around the axis, an edge on the radial outer side of the frame downstream-side end plate defines an edge on the axial downstream side of the opening, and the edge on the radial inner side of the casing downstream-side end plate and the edge on the radial outer side of the frame downstream-side end plate are connected to each other.

3. The exhaust chamber of a steam turbine according to claim 2, wherein an inner surface facing the exhaust auxiliary space in the frame downstream-side end plate and an inner surface facing the exhaust space in the casing downstream-side end plate are smoothly continuous with each other in a portion where the frame downstream-side end plate and the casing downstream-side end plate are connected to each other.

4. The exhaust chamber of a steam turbine according to claim 3, further comprising:

a second exhaust auxiliary space communicating with at least a portion on the non-exhaust side in the exhaust space, and forming a second auxiliary exhaust frame different from a first exhaust auxiliary space which is the exhaust auxiliary space, in addition to a first auxiliary exhaust frame which is the auxiliary exhaust frame, wherein the exhaust casing has a casing outer peripheral plate that defines an edge on the radial outer side in the exhaust space, the second auxiliary exhaust frame has a second frame inner peripheral plate spreading in the circumferential direction and extending in a direction including an axial direction in which the axis extends from the casing downstream-side end plate, at a position on the non-exhaust side with reference to the axis and on the radial inner side from the casing outer peripheral plate, the second frame inner peripheral plate defines an edge on the radial inner side of the second exhaust auxiliary space, and an edge on an axial upstream side opposite to the axial downstream side in the second frame inner peripheral plate defines an edge on the radial inner side of a second opening through which the exhaust space and the second exhaust auxiliary space communicate with each other.

5. The exhaust chamber of a steam turbine according to claim 4, wherein the second frame inner peripheral plate gradually spreads to the radial outer side toward the axial upstream side.

6. The exhaust chamber of a steam turbine according to claim 4, wherein the second frame inner peripheral plate extends toward the axial downstream side from an end on the radial outer side of the casing downstream-side end plate, and the second exhaust auxiliary space is formed on the axial downstream side from the casing downstream-side end plate.

7. The exhaust chamber of a steam turbine according to claim 4, wherein the second frame inner peripheral plate extends toward the axial upstream side from a position on the radial inner side from an end on the radial outer side in the casing downstream-side end plate, and the second exhaust auxiliary space is formed on the axial upstream side from the casing downstream-side end plate.

8. The exhaust chamber of a steam turbine according to claim 1, wherein the auxiliary exhaust frame has a frame upstream-side end plate that defines an edge on the axial upstream side in the exhaust auxiliary space, the frame upstream-side end plate has an annular shape around the axis, and an edge on the radial outer side of the frame upstream-side end plate is connected to a portion that defines an edge on the axial upstream side of the opening, which is an edge on the axial downstream side of the inner diffuser.

9. The exhaust chamber of a steam turbine according to claim 8, wherein an inner surface facing the exhaust auxiliary space in the frame upstream-side end plate is a surface gradually facing the axial upstream side toward the radial inner side.

10. The exhaust chamber of a steam turbine according to claim 1, wherein the auxiliary exhaust frame has a frame upstream-side end plate that defines an edge on the axial upstream side in the exhaust auxiliary space, the frame upstream-side end plate has an annular shape around the axis, and an edge on the radial outer side of the frame upstream-side end plate is connected to the inner diffuser at a position on the axial upstream side from an edge on the axial upstream side of the opening.

11. A steam turbine comprising:

the exhaust chamber of a steam turbine according to claim 1;

the steam turbine rotor;

a cylinder casing that covers an outer peripheral side of the steam turbine rotor; and a stator blade row disposed on an inner peripheral side of the cylinder casing, and in which an end on the radial outer side is attached to the cylinder casing, wherein the outer diffuser is connected to the cylinder casing.

12. An exhaust chamber of a steam turbine which guides steam flowing out from a last stage rotor blade row of a steam turbine rotor rotating around an axis to an outside, comprising:

a diffuser into which the steam flowing out from the last stage rotor blade row flows, having an annular shape with respect to the axis, and forming a diffuser space that gradually spreads to a radial outer side with respect to the axis toward an axial downstream side;

an exhaust casing having an exhaust port open toward the radial outer side, communicating with the diffuser space, spreading in a circumferential direction with respect to the axis, and forming an exhaust space that guides the steam flowing from the diffuser space to the exhaust port; and an auxiliary exhaust frame including a partial region on a radial inner side from the diffuser with respect to the axis, and forming an exhaust auxiliary space having an annular shape around the axis, wherein the diffuser has an outer diffuser having an annular cross section perpendicular to the axis, gradually spreading to the radial outer side toward the axial downstream side, and defining an edge on the radial outer side of the diffuser space, and an inner diffuser having an annular cross section perpendicular to the axis, gradually spreading to the radial outer side toward the axial downstream side, and defining an edge on the radial inner side of the diffuser space with respect to the axis, the exhaust casing has an exhaust port only on an exhaust side, out of a non-exhaust side and the exhaust side which are sides to opposite to each other with reference to the axis in an orthogonal direction orthogonal to the axis, the auxiliary exhaust frame has an opening open toward the radial outer side from an inside of the exhaust auxiliary space, in at least a portion on the non-exhaust side and the exhaust side with reference to the axis, and through which the exhaust space and the exhaust auxiliary space communicate with each other, and the opening has an annular shape with reference to the axis.

* * * * *